US011033115B2

(12) United States Patent
Jewett et al.

(10) Patent No.: US 11,033,115 B2
(45) Date of Patent: Jun. 15, 2021

(54) COMFORT LAYER HAVING REPEATING PATTERN OF POCKETED MINI COIL SPRINGS OF DIFFERENT HEIGHTS

(71) Applicant: L&P Property Management Company, South Gate, CA (US)

(72) Inventors: Jason V. Jewett, Carthage, MO (US); Randall L. Nichols, Carthage, MO (US); Shaw F. Robertson, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 148 days.

(21) Appl. No.: 16/351,650

(22) Filed: Mar. 13, 2019

(65) Prior Publication Data

US 2020/0288875 A1 Sep. 17, 2020

(51) Int. Cl.
*A47C 27/06* (2006.01)
*A47C 27/15* (2006.01)

(52) U.S. Cl.
CPC ..... *A47C 27/064* (2013.01); *A47C 27/15* (2013.01)

(58) Field of Classification Search
CPC ..... A47C 27/064; A47C 27/15; A47C 27/062
See application file for complete search history.

(56) References Cited

U.S. PATENT DOCUMENTS 1,406,051 A * 2/1922 Marcus ..... A47C 27/04 5/655.8
3,868,383 A 2/1975 Hackler
4,234,983 A 11/1980 Stumpf
4,451,946 A 6/1984 Stumpf
4,485,506 A 12/1984 Stumpf et al.
4,573,741 A 3/1986 Kirchner-Carl
4,574,099 A 3/1986 Nixon
4,594,278 A 6/1986 Nixon
5,105,488 A 4/1992 Hutchinson et al.
5,438,718 A 8/1995 Kelly et al.
6,154,908 A 12/2000 Wells
6,319,864 B1 11/2001 Hannigan et al.
6,353,952 B1 * 3/2002 Wells ..... A47C 27/062 5/716

(Continued)

FOREIGN PATENT DOCUMENTS

DE 102016119742 A1 * 4/2018 ..... A47C 27/062
EP 1067090 1/2001

(Continued)

*Primary Examiner* — Robert G Santos
*Assistant Examiner* — Alison N LaBarge
(74) *Attorney, Agent, or Firm* — Wood Herron & Evans LLP

(57) ABSTRACT

A posturized comfort layer for a bedding or seating product has different sections of different firmness due to different pocketed mini coil springs within the sections. The springs may be individually pocketed between two sheets of non-woven polypropylene fabric joined with circular or rectangular weld seams. Regardless of the shape of the weld seams, the different firmness of the different sections of the comfort layer may be due to different mini coil springs contained in the pockets. In some embodiments, all pockets may have the same spring and the springs contained in different size weld seams to create pockets of different heights.

19 Claims, 29 Drawing Sheets

(56) References Cited

U.S. PATENT DOCUMENTS

| | | | | |
|---|---|---|---|---|
| 6,398,199 | B1 * | 6/2002 | Barber | A47C 27/064 267/93 |
| 6,447,874 | B2 | 9/2002 | Antinori et al. | |
| 6,537,930 | B1 | 3/2003 | Middlesworth et al. | |
| 6,591,438 | B1 | 7/2003 | Edling | |
| 6,598,251 | B2 | 7/2003 | Habboub et al. | |
| 6,602,809 | B1 | 8/2003 | Cabrey | |
| 6,706,225 | B2 | 3/2004 | Cabrey | |
| 6,826,796 | B1 | 12/2004 | Mossbeck | |
| 6,862,763 | B2 | 3/2005 | Mossbeck et al. | |
| 6,883,196 | B2 | 4/2005 | Barber | |
| 7,410,030 | B2 | 8/2008 | Fusiki et al. | |
| 7,622,406 | B2 | 11/2009 | Holland et al. | |
| 7,636,972 | B2 | 12/2009 | Mossbeck et al. | |
| 7,788,952 | B2 | 9/2010 | Morrison | |
| 7,820,570 | B2 | 10/2010 | Holland et al. | |
| 7,828,029 | B2 | 11/2010 | Holland et al. | |
| 7,877,964 | B2 | 2/2011 | Spinks et al. | |
| 8,011,046 | B2 | 9/2011 | Stjerna | |
| 8,087,114 | B2 | 1/2012 | Lundevall | |
| 8,136,187 | B2 | 3/2012 | Mossbeck et al. | |
| 8,157,051 | B2 | 4/2012 | Marcel et al. | |
| 8,322,487 | B1 | 12/2012 | Kitchen et al. | |
| 8,464,830 | B2 | 6/2013 | Ishikawa et al. | |
| 8,474,078 | B2 | 7/2013 | Mossbeck | |
| 8,574,700 | B2 | 11/2013 | Hattori | |
| 8,695,757 | B2 | 4/2014 | Duval et al. | |
| 9,133,615 | B2 | 9/2015 | Bischoff et al. | |
| 9,635,952 | B1 | 5/2017 | Anthony et al. | |
| 9,943,173 | B2 | 4/2018 | Krtek et al. | |
| 9,968,202 | B2 | 5/2018 | Long | |
| 2002/0025747 | A1 | 2/2002 | Rock et al. | |
| 2003/0009831 | A1 | 1/2003 | Giori et al. | |
| 2003/0074736 | A1 | 4/2003 | Grothaus | |
| 2003/0104735 | A1 | 6/2003 | Rock et al. | |
| 2004/0010853 | A1 | 1/2004 | Muci et al. | |
| 2004/0103479 | A1 * | 6/2004 | Mossbeck | A47C 23/0433 5/720 |
| 2004/0128773 | A1 * | 7/2004 | Barber | F16F 1/08 5/716 |
| 2005/0257323 | A1 * | 11/2005 | Edling | B68G 9/00 5/720 |
| 2005/0273938 | A1 | 12/2005 | Metzger et al. | |
| 2007/0044243 | A1 | 3/2007 | Metzger | |
| 2007/0137926 | A1 | 6/2007 | Albin, Jr. et al. | |
| 2007/0289069 | A1 | 12/2007 | Wells | |
| 2009/0211028 | A1 | 8/2009 | Richmond et al. | |
| 2009/0222985 | A1 | 9/2009 | Richmond et al. | |
| 2009/0298374 | A1 | 12/2009 | Delmas | |
| 2010/0212090 | A1 | 8/2010 | Stjerna | |
| 2010/0255270 | A1 | 10/2010 | Stuebiger | |
| 2011/0014406 | A1 | 1/2011 | Coleman et al. | |
| 2011/0113551 | A1 | 5/2011 | Lin | |
| 2011/0314613 | A1 | 12/2011 | Haffner et al. | |
| 2013/0029550 | A1 | 1/2013 | Seth et al. | |
| 2013/0174350 | A1 | 7/2013 | Allman et al. | |
| 2013/0198941 | A1 | 8/2013 | John et al. | |
| 2013/0334747 | A1 | 12/2013 | Spinks | |
| 2014/0287643 | A1 | 9/2014 | Nozaki et al. | |
| 2014/0373282 | A1 | 12/2014 | Mossbeck et al. | |
| 2015/0026893 | A1 | 1/2015 | Garrett et al. | |
| 2015/0284901 | A1 | 10/2015 | Blackwell, Jr. et al. | |
| 2015/0359349 | A1 | 12/2015 | Eigenmann et al. | |
| 2015/0359350 | A1 | 12/2015 | Eigenmann et al. | |
| 2016/0235212 | A1 | 8/2016 | Krtek et al. | |
| 2016/0235213 | A1 * | 8/2016 | Long | A47C 21/046 |
| 2017/0283245 | A1 * | 10/2017 | Long | B68G 9/00 |
| 2018/0325274 | A1 * | 11/2018 | Hager | A47C 27/064 |

FOREIGN PATENT DOCUMENTS

| | | |
|---|---|---|
| EP | 2789267 | 10/2014 |
| GB | 167025 | 2/1921 |
| WO | 1707081 | 4/2008 |
| WO | 2014023975 | 2/2014 |

* cited by examiner

COMFORT LAYER HAVING REPEATING PATTERN OF POCKETED MINI COIL SPRINGS OF DIFFERENT HEIGHTS

TECHNICAL FIELD OF THE INVENTION

This invention relates to a comfort layer for bedding and seating products. More particularly, this invention relates to a pocketed spring comfort layer for use in seating or bedding products.

BACKGROUND OF THE INVENTION

Comfort layers are commonly used in seating or bedding products above/below a core, which may or may not include a spring assembly. Such comfort layers may include foam, fiber and gel products. U.S. Pat. No. 8,087,114 discloses a comfort layer made of pocketed springs. Such spring assemblies may be made of strings of individually pocketed coil springs joined together or multiple coil springs joined together by helical lacing wires.

Comfort layers comprising mini pocketed coil springs have heretofore been a uniform firmness throughout. The mini pocketed coil springs have all been the same.

One desirable feature of known pocketed spring assemblies used as the core of bedding products is posturized support, i.e., one or more sections of the pocketed spring assembly being firmer than another section or other sections of the pocketed spring assembly. Due to the configuration of the human body laying on a bedding or seating product, additional support in a middle or lumbar section of the product may be desirable. Comfort layers are commonly used in seating or bedding products above/below a central core. The central core may or may not include a spring assembly. The central core is most commonly a pocketed or un-pocketed spring core. However, the central core of a bedding or seating product may be made partially or entirely of foam.

U.S. Pat. Nos. 9,968,202 and 9,943,173 each disclose a comfort layer made of pocketed mini coil springs configured to overlay a spring core of a bedding or seating product. Such comfort layers commonly have at least one layer of fabric above and at least one layer of fabric below individually pocketed mini coil springs.

One drawback to such pocketed spring comfort layers is that a mattress manufacturer may desire to place one or more foam or fiber layers above such a pocketed spring comfort layer so that a user does not detect or feel the pocketed spring comfort layer. In the case of a double-sided bedding or seating product, a mattress manufacturer may place one or more foam or fiber layers above one pocketed spring comfort layer and below another pocketed spring comfort layer on the opposite surface of the central core of the product.

It is therefore an objective of this invention to provide a pocketed spring comfort layer adapted to overlay a central core of a seating or bedding product which may eliminate or reduce the need for a mattress manufacturer to place one or more foam or fiber layers above the pocketed spring comfort layer and yet obtain a posturized effect.

It is another objective of this invention to provide a pocketed spring comfort layer adapted to overlay a central core of a seating or bedding product which may reduce the number or thickness of foam or fiber layers a mattress manufacturer may elect to place above such a pocketed spring comfort layer, thereby reducing the cost of the finished mattress by the cost of such layers and the associated cost of applying them while still obtaining different firmness in different regions.

It is another objective of this invention to provide a pocketed spring comfort layer for a seating or bedding product which has different regions or sections of different firmness.

SUMMARY OF THE INVENTION

The invention, which accomplishes these objectives, comprises a comfort layer configured to overlay a central core of a seating or bedding product. The comfort layer comprises an assembly or matrix of individually pocketed mini coil springs, each mini coil spring being contained within a fabric pocket. The fabric pocketing material within which the mini coil springs are contained may be any known fabric, including a non-woven polypropylene fabric commonly used in the bedding industry.

Any of the embodiments of comfort layer shown or described herein may be incorporated into a bedding product, such as a mattress, foundation or pillow. Further, any of the embodiments of comfort layer shown or described herein may be incorporated into a seating product, such as a vehicle seat and/or office or residential furniture, such as a recliner. Alternatively, any of the embodiments of comfort layer shown or described herein may be sold independently as a retail or wholesale item. In such an application, the comfort layer may be added to and/or removed from a bedding or seating product by a customer. Most embodiments of comfort layer are configured to overlay a core of a bedding or seating product such as a pocketed spring core, for example.

According to one aspect of the invention, the comfort layer, whether incorporated inside a bedding or seating product or manufactured and sold as a separate product, comprises a matrix of pocketed mini coil springs. Each mini coil spring is contained within a pocket, the pocket having a weld seam at least partially around the pocket joining first and second pieces of fabric to create a pocketed mini coil spring. Each weld seam may be a solid seam or comprise multiple weld segments with gaps between the weld segments.

In multiple embodiments, the comfort layer has aligned rows and columns of pocketed mini coil springs. The pocketed mini coil springs have a repeating pattern of at least two different heights within at least one of the rows and columns. In one of these repeating patterns, within at least one of the rows and columns, every other pocketed mini coil spring has a first height and every other pocketed mini coil spring has a second height, the second height being different than the first height. The pocketed mini coil springs with at least one row or column may have different heights due, at least in part to different mini coil springs being inside the pockets of the pocketed mini coil springs. In one embodiment, each of the rows and columns has along its length, pocketed mini coil springs having different heights in a repeating pattern. In one embodiment, along at least one row or column, every other pocketed mini coil spring has a first height and every other pocketed mini coil spring has a second height, the second height being different than the first height. In other words, the comfort layer has pocketed mini coil springs with alternating heights along at least one row or column.

In some embodiments, the weld seams are circular and the weld segments are curved. In other embodiments, the weld seams are rectangular and the weld segments straight. In most embodiments, the weld segments and the gaps therebetween are the same size. However, the weld segments may be different sizes, regardless of the shape of the weld seams.

The comfort layer, whether incorporated inside a bedding or seating product or manufactured and sold as a separate product, comprises a matrix of mini coil springs, a first piece of fabric on one side of the matrix of mini coil springs and a second piece of fabric on another side of the matrix of mini coil springs. The first and second pieces of fabric are joined with weld seams at least partially around each of the mini coil springs to create individual pockets which contain the mini coil springs. The weld seams may comprise weld segments with gaps between the weld segments or may comprise continuous, uninterrupted welds. The comfort layer has aligned rows and columns of pocketed mini coil springs. The pocketed mini coil springs are arranged in a checkerboard pattern, every other pocketed mini coil spring having a first height and every other pocketed mini coil spring having a second height, the second height being different than the first height. The mini coil springs of the pocketed mini coil springs having the first height may have a different diameter than the mini coil springs of the pocketed mini coil springs having the second height. In one embodiment the first height is greater than the second height. In some embodiments, the mini coil springs of the pocketed mini coil springs having the first height may have a different out-of-pocket height than the mini coil springs of the pocketed mini coil springs having the second height.

The comfort layer, whether incorporated inside a bedding or seating product or manufactured and sold as a separate product, comprises mini coil springs, a first piece of fabric on one side of the mini coil springs and a second piece of fabric on another side of the mini coil springs. The first and second pieces of fabric are joined with weld seams at least partially around each of the mini coil springs to create individual pockets which contain the mini coil springs. The weld seams may be continuous welds or comprise weld segments with gaps between the weld segments. The comfort layer has rows and columns of pocketed mini coil springs arranged in a nested configuration. Within at least one of the rows and columns every other pocketed mini coil spring has a first height and every other pocketed mini coil spring has a second height, the second height being different than the first height. The different heights of the pocketed mini coil springs may be due, at least in part, to different mini coil springs being inside the pockets of the pocketed mini coil springs. In some embodiments, the pocketed mini coil springs along at least one of the rows and columns may have a different repeating pattern, such as for example, tall, short, short and then tall, short, short again. In some embodiments, the pocketed mini coil springs along at least one of the rows and columns may have more than two different heights.

By changing the gauge of wire, out-of-pocket diameter or out-of-pocket height or any combination thereof of the mini coil springs of the comfort layer, a comfort layer having pocketed mini coil springs of different heights may be constructed.

Alternatively, by changing the size of the weld seams containing the mini coil springs of the comfort layer, a comfort layer may be constructed using the same mini coil springs.

These and other objects and advantages of this invention will be more readily apparent from the following drawings, in which:

DETAILED DESCRIPTION OF THE DRAWINGS

Figure 1:
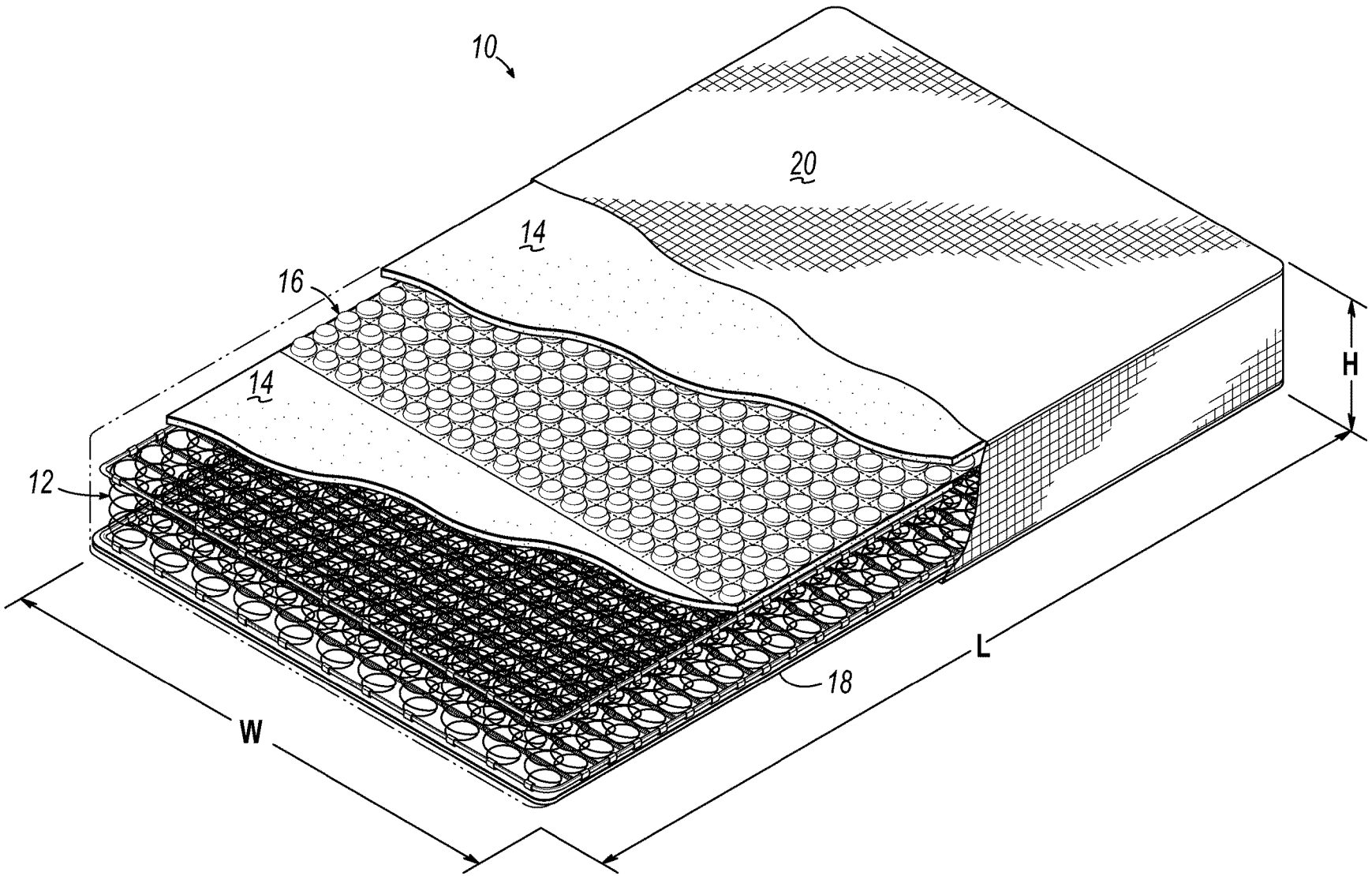
FIG. 1 is a perspective view, partially broken away, of a bedding product incorporating one of the comfort layers of this invention.

With reference to FIG. 1, there is illustrated a single-sided mattress 10 incorporating one embodiment of comfort layer in accordance with this invention. This mattress 10 comprises a spring core 12 over the top of which there is a conventional cushioning pad 14 which may be partially or entirely made of foam or fiber or gel, etc. The cushioning pad 14 may be covered by a posturized comfort layer 16 constructed in accordance with one embodiment of the invention. A second conventional cushioning pad 14 may be located above the posturized comfort layer 16. In some applications, one or both cushioning pads 14 may be omitted. This complete assembly may be mounted upon a base 18 and is completely enclosed within an upholstered cover 20.

As shown in FIG. 1, mattress 10 has a longitudinal dimension or length L, a transverse dimension or width W and a height H. Although the length L is shown as being greater than the width W, they may be identical. The length, width and height may be any desired distance and are not intended to be limited by the drawings.

While several embodiments of comfort layer are illustrated and described as being embodied in a single-sided mattress, any of the comfort layers shown or described herein may be used in a single-sided mattress, double-sided mattress or seating cushion. In the event any such comfort layer is utilized in connection with a double-sided product, then the bottom side of the product's core may have a comfort layer applied over the bottom side of the core, and either comfort layer may be covered by one or more cushioning pads made of any conventional material. Either the cushioning pad or pads, on top and/or bottom of the core, may be omitted. The novel features of the invention reside in the comfort layer.

Figure 1A:
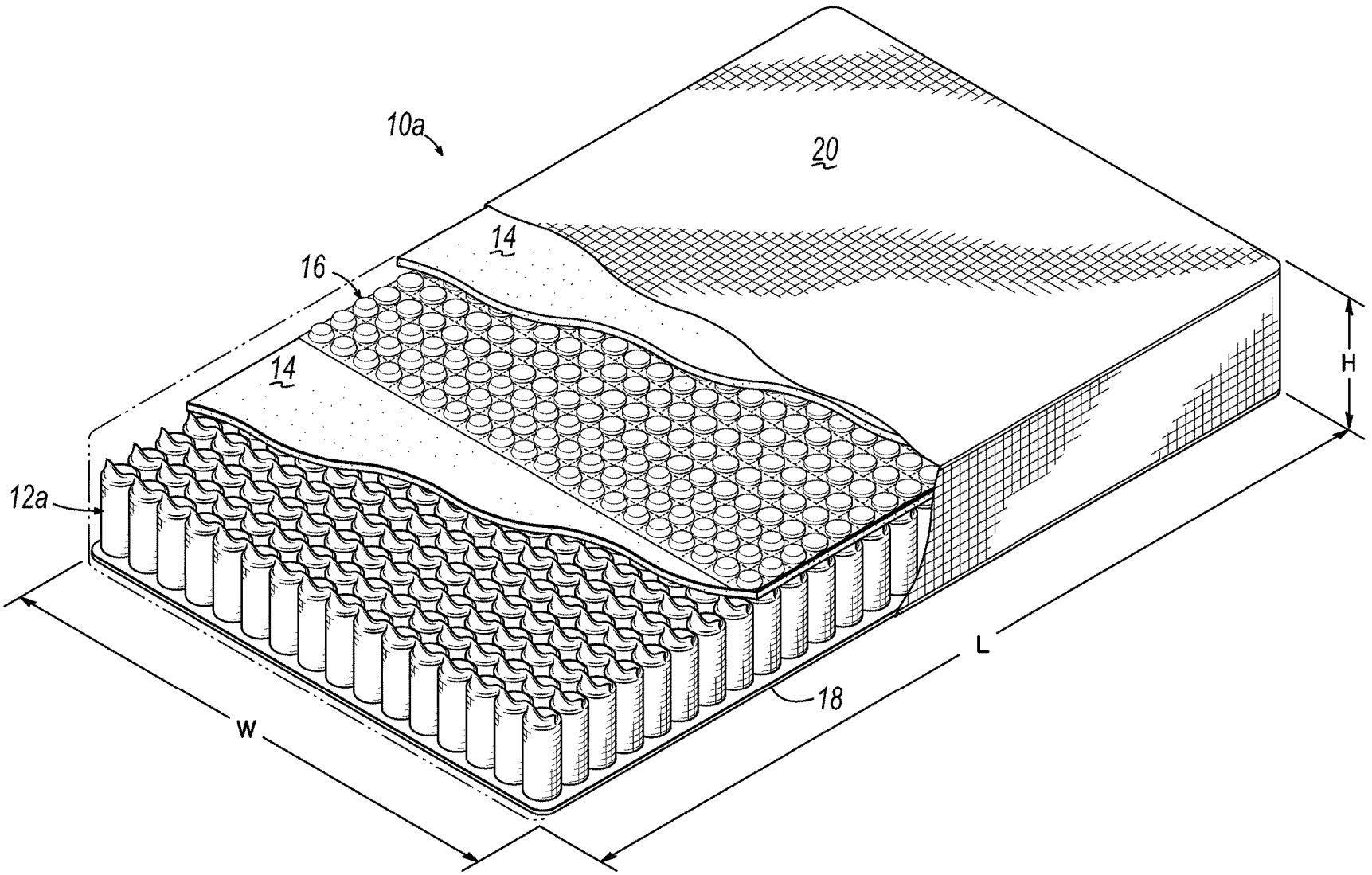
FIG. 1A is a perspective view, partially broken away, of another bedding product incorporating the comfort layer of FIG. 1.

FIG. 1A illustrates another mattress 10*a* having the same components as mattress 10 except a pocketed spring core 12*a* rather than a conventional spring core 12 shown in FIG. 1. Although spring core 12 is illustrated being made of unpocketed coil springs held together with helical lacing wires, the core of any of the products, such as mattresses shown or described herein, may be made wholly or partially of pocketed coil springs (see FIG. 1A), one or more foam pieces (not shown) or any combination thereof. Any of the comfort layers described or shown herein may be used in any single or double-sided bedding or seating product having any conventional core. This document is not intended to limit in any way the core. The core may be any conventional core including, but not limited to, pocketed or conventional spring cores.

Figure 4:
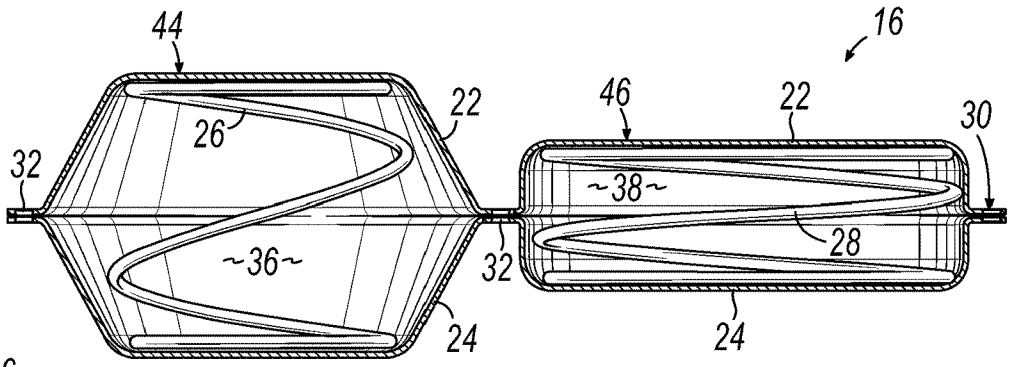
FIG. 4 is a cross-sectional view taken along the line 4-4 of FIG. 3.
Figure 3:
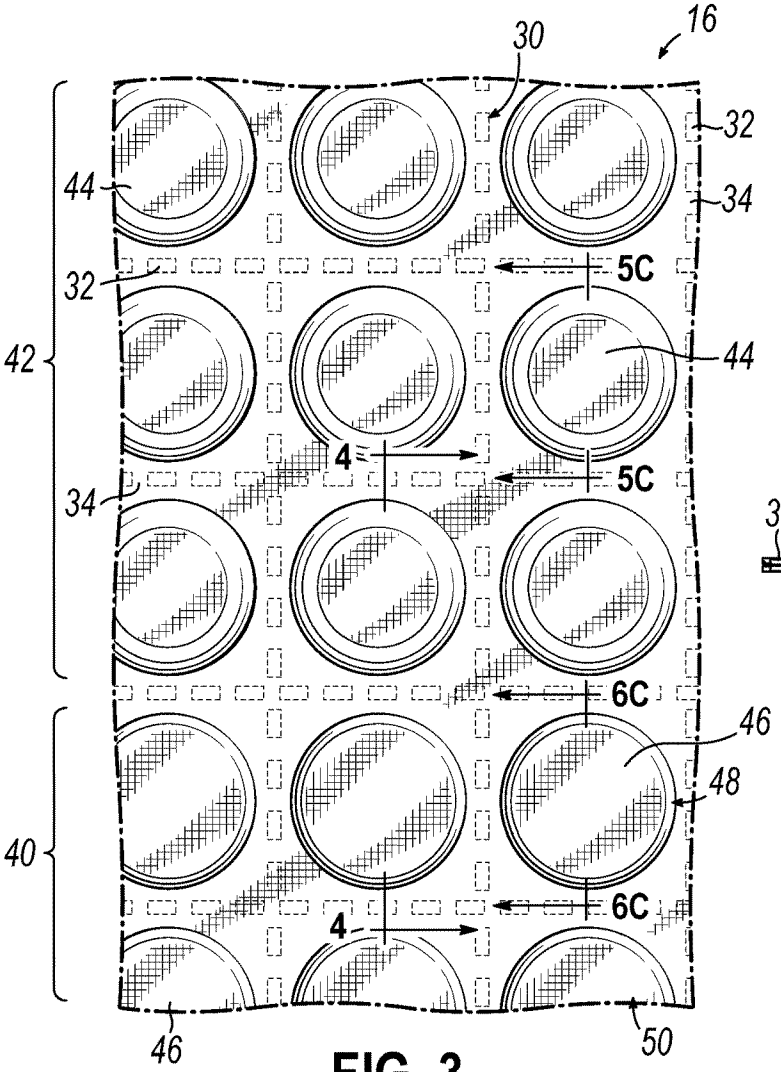
FIG. 3 is an enlarged top view of the area 3 of FIG. 2.

FIGS. 3 and 4 illustrate the components of one embodiment of posturized comfort layer 16 incorporated into the mattress 10 shown in FIG. 1. As best shown in FIG. 4, the posturized comfort layer 16 comprises a first or upper piece of fabric 22 and a second or lower piece of fabric 24 with a plurality of mini coil springs 26, 28 therebetween. The fabric pieces 22, 24 are made of non-woven polypropylene in one embodiment, but may be made of any known material. The fabric pieces 22, 24 are preferably made of the same material, but may be made of different materials. The fabric pieces 22, 24 are joined together with rectangular weld seams 30, each rectangular seam 30 surrounding one of the mini coil springs 26 or 28.

Each rectangular seam 30 comprises multiple straight or linear weld segments 32 with gaps 34 therebetween. The first and second pieces of fabric 22, 24 are joined together along each straight or linear weld segment 32 of each rectangular seam 30. The first and second pieces of fabric 22, 24 are not joined together along each gap 34 between adjacent weld segments 32 of each rectangular seam 30. The straight or linear weld segments 32 are strategically placed around a mini coil spring 26, 28 and create the rectangular seam 30. The two pieces of fabric 22, 24, in combination with one of the rectangular weld seams 30, define a pocket 36, 38 inside of which is at least one mini coil spring 26, 28, respectively. For purposes of this document, the two pieces of fabric 22, 24, in combination with one of the rectangular weld seams 30 and at least one mini coil spring 26, 28 define a pocketed mini coil spring 44, 46, respectively.

Figure 4A:
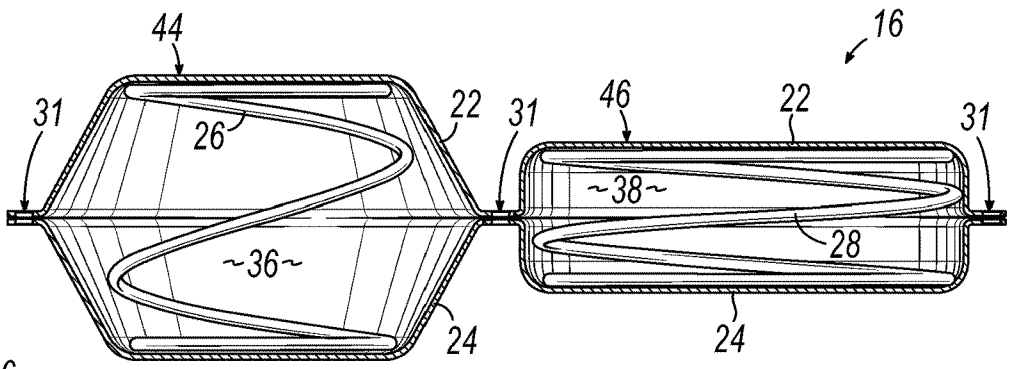
FIG. 4A is a cross-sectional view taken along the line 4A-4A of FIG. 3A.
Figure 3A:
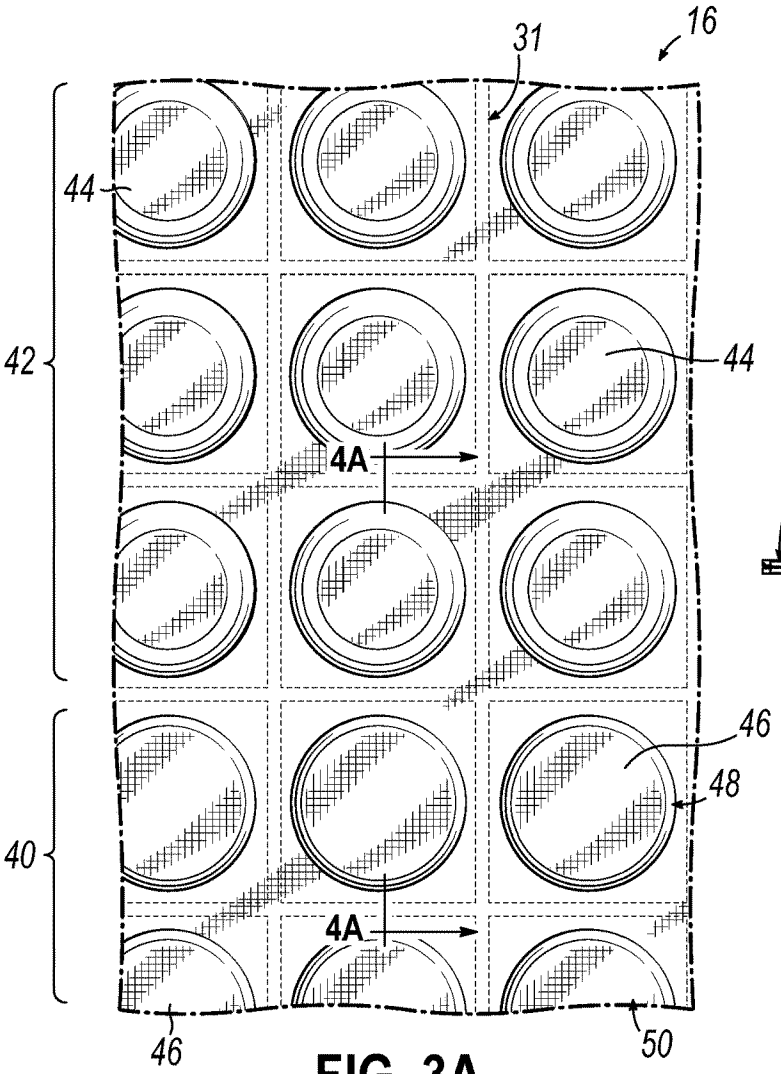
FIG. 3A is an enlarged top view like FIG. 3 with different weld seams.

FIGS. 3A and 4A illustrate the components of posturized comfort layer 16 shown in FIGS. 3 and 4, but with solid rectangular weld seams 31 in place of segmented weld seams 30. In any of the embodiments described herein or shown, solid or partially solid weld seams may replace segmented weld seams of any shape, including circular weld seams. FIGS. 3A and 4A are merely one example.

Figure 2:
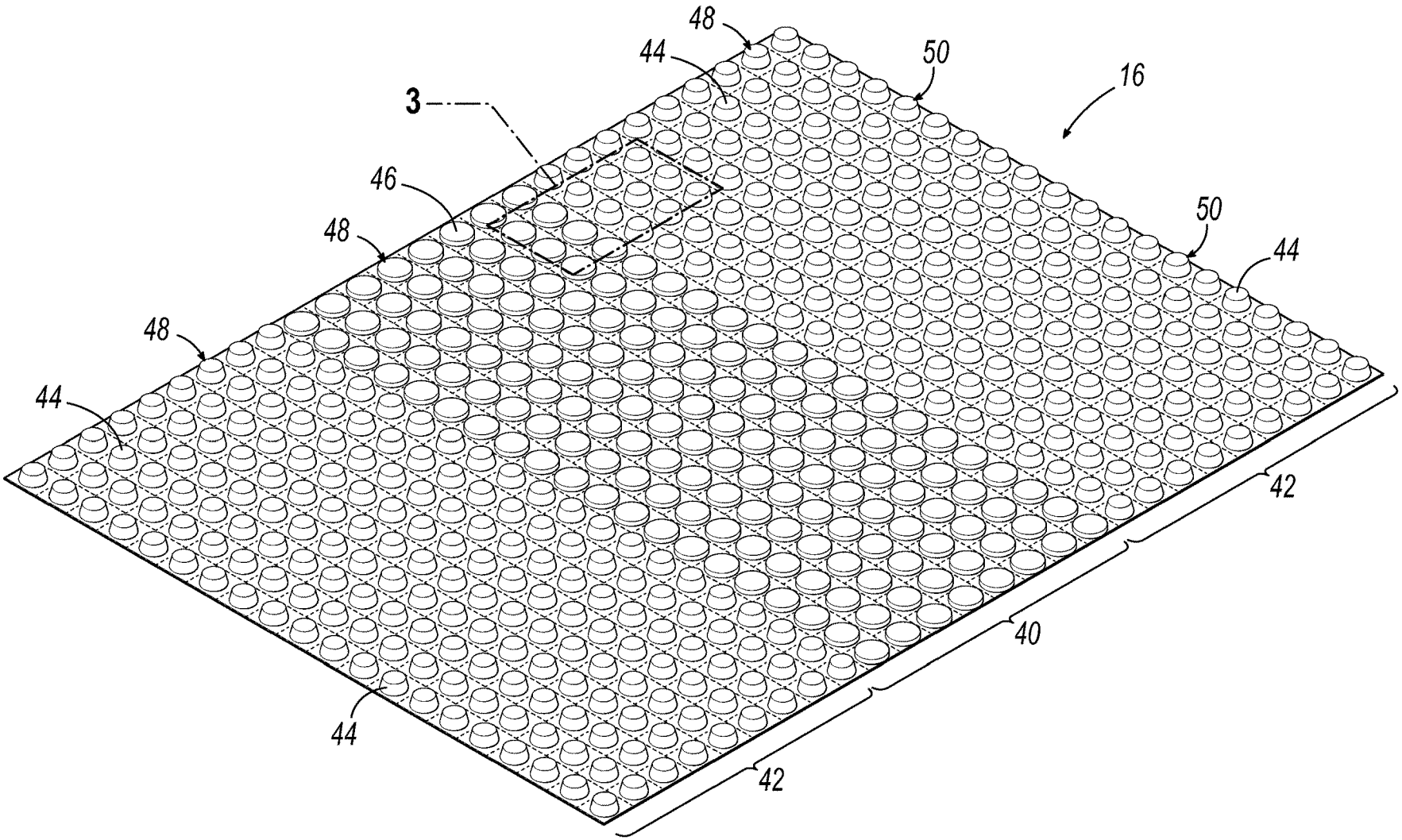
FIG. 2 is a perspective view of the comfort layer used in the bedding product of FIG. 1.

As best shown in FIGS. 2 and 3, the pocketed mini coil springs 44, 46 are arranged in a matrix of aligned transversely extending rows 48 extending from side-to-side and longitudinally extending columns 50 extending from head-to-foot. See FIGS. 3 and 4.

During the welding process, the mini coil springs 26, 28 may be at least partially compressed before pocket 36, 38 is closed and thereafter. If desired, resilient members other than mini coil springs, such as foam members, may be used in this embodiment and any embodiment disclosed or shown herein. Alternatively, resilient members made of resilient material, other than foam which returns to its original configuration after a load is removed from the material, may be used inside the pockets in any embodiment disclosed or shown herein.

The size of the straight or linear weld segments 32 of rectangular seams 30 are not intended to be limited by the illustrations; they may be any desired size. Similarly, the size of the illustrated rectangular seams 30, is not intended to be limiting. The placement of the rectangular seams 30 shown in the drawings is not intended to be limiting either. Any desired arrangement of rectangular seams may be incorporated into any embodiment shown or described herein.

The weld segments 32 may assume shapes other than the straight or linear weld segments illustrated. For example, the weld seams 32 may be other shapes, such as triangles or circles or ovals of the desired size and pattern. This holds true for any of the weld seams described herein regardless of whether circular or rectangular and regardless of the comfort layer described herein or shown in this document.

FIG. 2 illustrates the posturized comfort layer 16 having a center section 40 and two end sections 42 on opposite sides of the center section 40. Each of the three sections 40, 42 is illustrated being generally rectangular shaped and approximately the same size. However, any one of the sections may be a different size than any other section. For example, the end sections 42 may be a different size than the middle or center section 40. The drawings are not intended to be limiting.

Figure 5A:
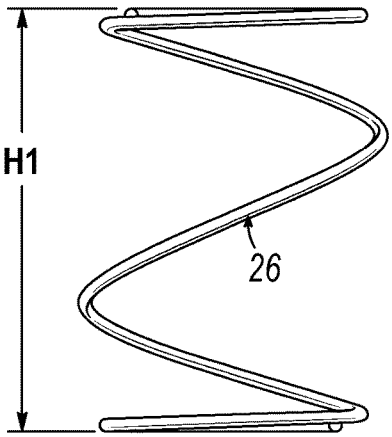
FIG. 5A is a side elevational view of one of the mini coil springs used in the end sections of the comfort layer of FIG. 2.
Figure 5B:
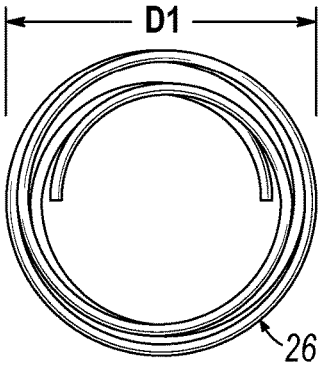
FIG. 5B is a top view of the mini coil spring of FIG. 5A.
Figure 5C:
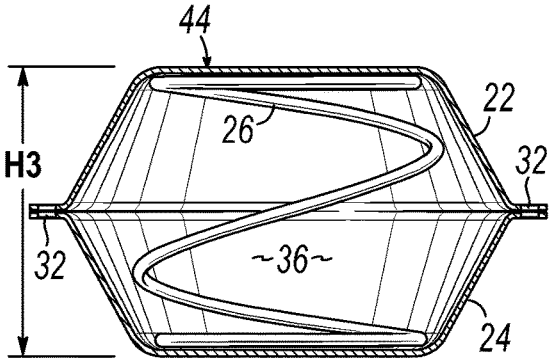
FIG. 5C is a cross-sectional view taken along the line 5C-5C of FIG. 3.

Each of the end sections 42 has identical pocketed mini coil springs 44. For purposes of this document, each of the end sections 42 will be referred to as a "tall" section, and each of the pocketed mini coil springs 44 will be referred to as a "tall" pocketed mini coil spring. Each tall pocketed mini coil spring 44, shown in detail in FIGS. 4 and 5C, comprises a partially compressed mini coil spring 26 and first and second pieces 22, 24 of fabric joined together with a rectangular weld seam 30. As shown in FIG. 5A, each mini coil spring 26 has an out-of-pocket height H1 in its relaxed or non-compressed condition. As shown in FIG. 5B, each mini coil spring 26 has a diameter of D1 in its relaxed or non-compressed condition. As shown in FIGS. 4 and 5C, each mini coil spring 26, when pocketed, creates a tall pocketed mini coil spring 44 having a pocketed height H3, less than the out-of-pocket height H1 of mini coil spring 26.

Figure 6A:
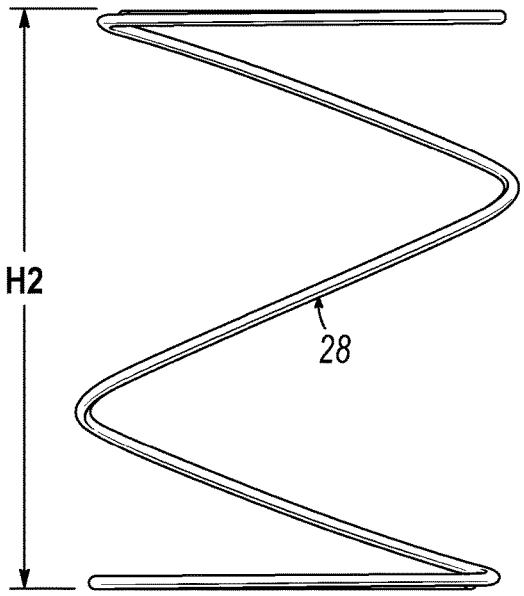
FIG. 6A is a side elevational view of one of the mini coil springs used in the middle section of the comfort layer of FIG. 2.
Figure 6B:
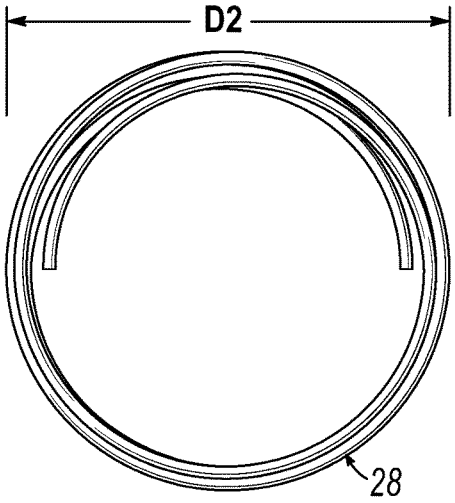
FIG. 6B is a top view of the mini coil spring of FIG. 6A.
Figure 6C:
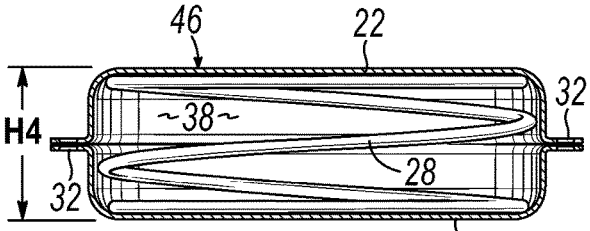
FIG. 6C is a cross-sectional view taken along the line 6C-6C of FIG. 3.

The center section 40 has identical pocketed mini coil springs 46. For purposes of this document, the center section 40 will be referred to as a "short" section, and each of the pocketed mini coil springs 46 will be referred to as a "short" pocketed mini coil spring. Each short pocketed mini coil spring 46, shown in detail in FIGS. 4 and 6C, comprises a mini coil spring 28 and first and second pieces 22, 24 of fabric joined together with a rectangular weld seam 30. As shown in FIG. 6A, each mini coil spring 28 has an out-of-pocket height H2 in its relaxed or non-compressed condition, greater than the out-of-pocket height H1 of mini coil spring 26 shown in FIG. 5A. As shown in FIG. 6B, each mini coil spring 28 has diameter D2 in its relaxed or non-compressed condition greater than the diameter D1 of mini coil spring 26 shown in FIG. 5B. As shown in FIGS. 4 and 6C, each mini coil spring 28, when pocketed, creates a short pocketed mini coil spring 46 having a height H4, less than the height H3 of tall pocketed mini coil spring 44 shown in FIG. 5C and less than the out-of-pocket height H2 of mini coil spring 28.

Each of the pocketed mini coil springs of the center section 40 is illustrated being a short pocketed mini coil spring 46, as described herein and shown in FIGS. 4 and 6C. Each of the pocketed mini coil springs of each of the end sections 42 is illustrated being a tall pocketed mini coil spring 44, as described herein and shown in FIGS. 4 and 5C. As shown in FIG. 2, each row 48 of tall pocketed mini coil springs 44 in the end sections 42 is identical. Similarly, each row 48 of short pocketed mini coil springs 46 in the center section 40 is identical. The center section 40 is shorter than the end sections 42 because the rows 48 of short pocketed mini coil springs 46 are shorter than the rows 48 of tall pocketed mini coil springs 44 in the end sections 42. As best seen in FIG. 2, each longitudinally extending column 50 of pocketed mini coil springs 44, 46 is identical along the length of the posturized comfort layer 16.

Any dimensions shown or described herein may be any desired dimensions and are not intended to be limited by this document. For example, dimensions H1-H5, D1 and D2 may be any desired dimensions. However, in one preferred embodiment, the out-of-pocket height H1 of mini coil spring 26 shown in FIG. 5A and the out-of-pocket height H1 of mini coil spring 54 shown in FIG. 8A may be approximately 1.25 inches. In the same preferred embodiment, the out-of-pocket height H2 of mini coil spring 28 shown in FIG. 5B, the out-of-pocket height H2 of mini coil spring 52 shown in FIG. 7A and the out-of-pocket height H5 of mini coil springs 60, 64 shown in FIGS. 9A and 10A, respectively, may be approximately 2.0 inches. In the same preferred embodiment, the diameter D1 of the uncompressed mini coil spring 26 shown in FIG. 5B and the mini coil spring 52 shown in FIG. 7B may be approximately 1.25 inches. In the same preferred embodiment, the diameter D2 of the uncompressed mini coil spring 28 shown in FIG. 66 and the mini coil spring 54 shown in FIG. 8B may be approximately 1.75 inches. In most embodiments, the height of the pocketed mini coil springs is less than three inches.

According to one aspect of the invention, the mini coil springs within a comfort layer, such as mini coil springs 26, 28, may be made of the same wire. In one embodiment, these mini coil springs 26, 28 may be both made of seventeen-gauge wire. However, any of the mini coil springs described herein or shown may be made of any gauge wire.

Figure 7A:
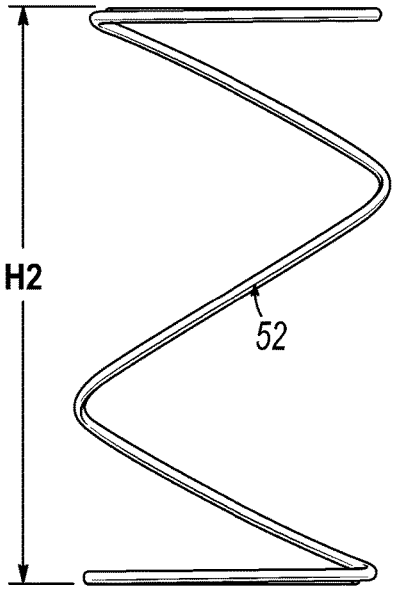
FIG. 7A is a side elevational view of a mini coil spring which may be used in any tall pocket of any comfort layer shown or described herein.
Figure 7B:
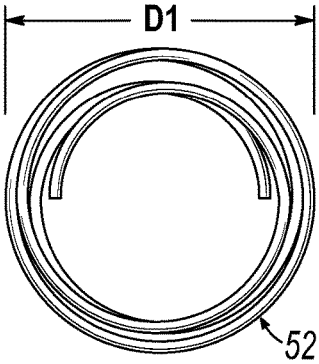
FIG. 7B is a top view of the mini coil spring of FIG. 7A.
Figure 7C:
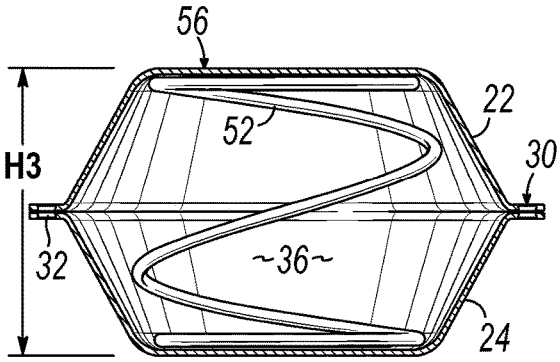
FIG. 7C is a cross-sectional view of the mini coil spring of FIGS. 7A and 7B shown partially compressed in a tall pocket.

FIGS. 7A and 7B show an alternative mini coil spring 52 in an out-of-pocket condition which may be at least partially compressed and pocketed to create a tall pocketed mini coil spring 56 shown in FIG. 7C. Tall pocketed mini coil spring 56 may be incorporated into any of the comfort layers shown or described herein, including posturized comfort layer 16. In place of tall pocketed mini coil springs 44, tall pocketed mini coil springs 56, shown in FIG. 7C, may be used in any of the comfort layers shown or described herein, including in each of the end sections 42 of posturized comfort layer 16. Each tall pocketed mini coil spring 56, shown in detail in FIG. 7C, comprises a mini coil spring 52, shown in a relaxed or non-compressed condition in FIG. 7A, and first and second pieces 22, 24 of fabric joined together with a rectangular weld seam 30. As shown in FIG. 7A, each mini coil spring 52 has an out-of-pocket height H2 in its relaxed or non-compressed condition. As shown in FIG. 7B, each mini coil spring 52 has diameter of D1 in its relaxed or non-compressed condition. As shown in FIG. 7C, each mini coil spring 52, when pocketed, creates a tall pocketed mini coil spring 56 having a pocketed height H3.

Figure 8A:
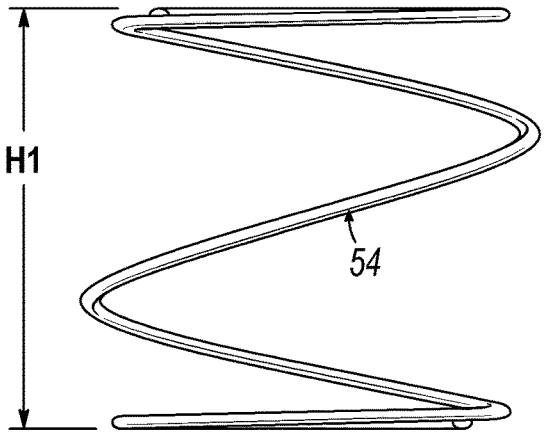
FIG. 8A is a side elevational view of a mini coil spring which may be used in any short pocket of any comfort layer shown or described herein.
Figure 8B:
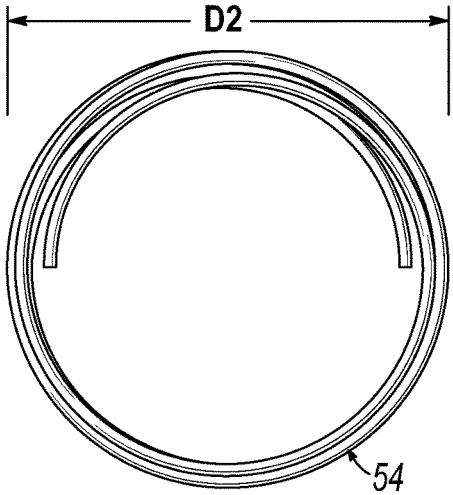
FIG. 8B is a top view of the mini coil spring of FIG. 8A.
Figure 8C:
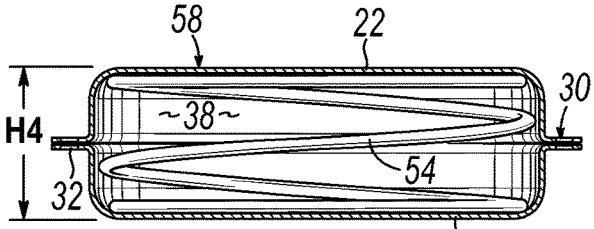
FIG. 8C is a cross-sectional view of the mini coil spring of FIGS. 8A and 8B shown partially compressed in a short pocket.

FIGS. 8A and 8B show an alternative mini coil spring 54 in an out-of-pocket condition, which may be at least partially compressed and pocketed to create a short pocketed mini coil spring 58 shown in FIG. 8C. Short pocketed mini coil springs 58 may be incorporated into any of the comfort layers shown or described herein, including posturized comfort layer 16. In place of short pocketed mini coil springs 46 shown in FIG. 6C, short pocketed mini coil springs 58 shown in FIG. 8C may be used in any of the short sections of any of the posturized comfort layers shown or descried herein, including the center section 40 of posturized comfort layer 16. Each short pocketed mini coil spring 58, shown in detail in FIG. 8C, comprises a mini coil spring 54 partially compressed between first and second pieces 22, 24 of fabric joined together with a rectangular weld seam 30. As shown in FIG. 8A, each mini coil spring 54 has an out-of-pocket height H1 in its relaxed or non-compressed condition, less than the out-of-pocket height H2 of mini coil spring 52 shown in FIG. 7A. As shown in FIG. 8B, each mini coil spring 54 has diameter D2 in its relaxed or non-compressed condition greater than the diameter D1 of the mini coil spring 52 shown in FIG. 7A. As shown in FIG. 8C, each mini coil spring 54, when at least partially compressed and pocketed, creates a short pocketed mini coil spring 58 having a height H4, less than the height H3 of tall pocketed mini coil spring 56 shown in FIG. 7C.

According to one aspect of the invention, the mini coil springs within a comfort layer, such as mini coil springs 52, 54, may be made of the same wire. In one embodiment, mini coil springs 52, 54 may be both made of seventeen-gauge wire. However, mini coil springs 52, 54 may be made of any gauge wire, including different gauge wires.

In any of the comfort layers shown or described herein, including posturized comfort layer 16, tall pocketed mini coil springs 44, like the one shown in FIG. 5C and short pocketed mini coil springs 46 like the one shown in FIG. 6C, may be used together in the same comfort layer. Similarly, the tall pocketed mini coil springs 56, like the one shown in FIG. 7C and short pocketed mini coil springs 58 like the one shown in FIG. 8C, may be used together in the same comfort layer.

Figure 9A:
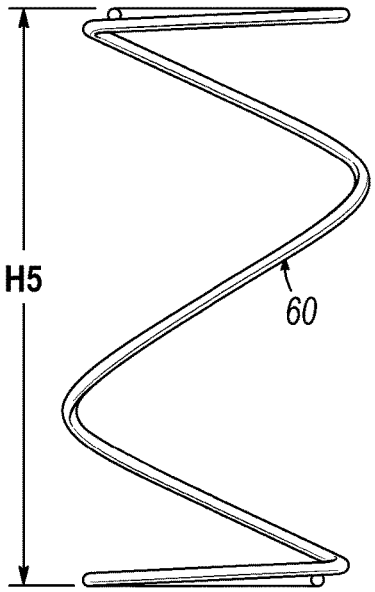
FIG. 9A is a side elevational view of a mini coil spring which may be used in any tall pocket of any comfort layer shown or described herein.
Figure 10A:
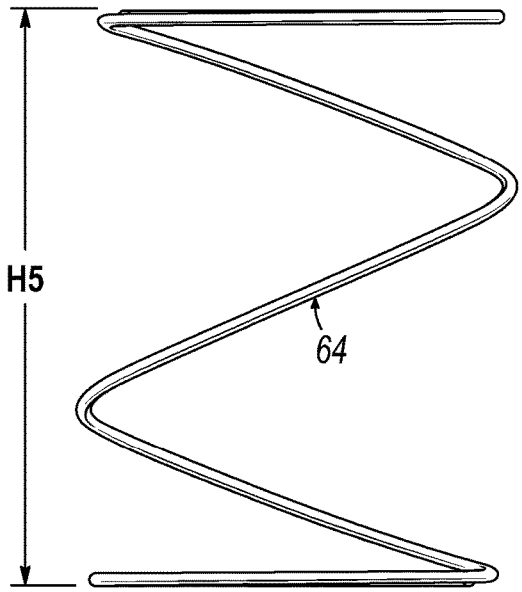
FIG. 10A is a side elevational view of a mini coil spring which may be used in any short pocket of any comfort layer shown or described herein.
Figure 9B:
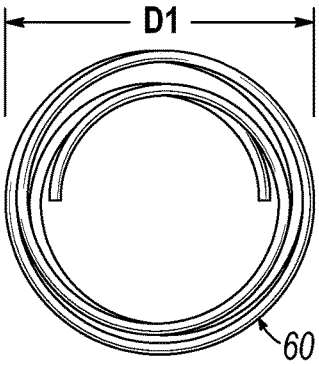
FIG. 9B is a top view of the mini coil spring of FIG. 9A.
Figure 10B:
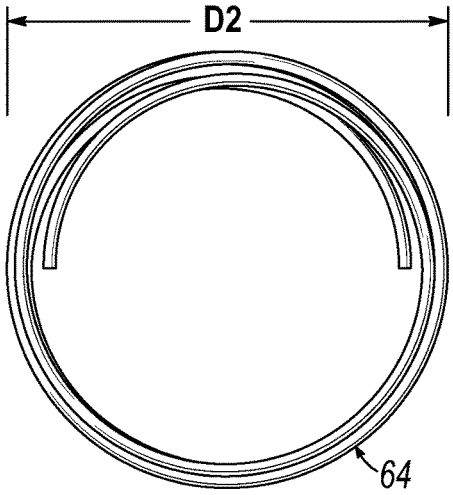
FIG. 10B is a top view of the mini coil spring of FIG. 10A.
Figure 9C:
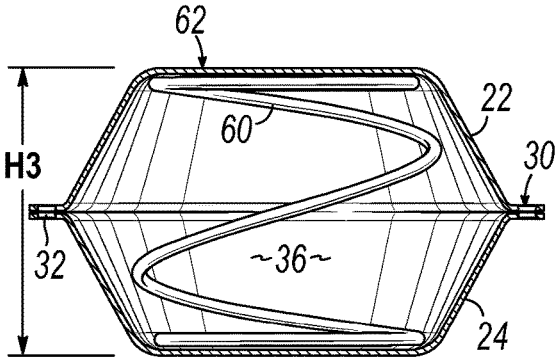
FIG. 9C is a cross-sectional view of the mini coil spring of FIGS. 9A and 9B shown partially compressed in a tall pocket.
Figure 10C:
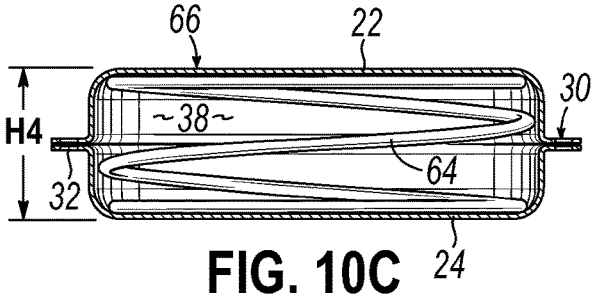
FIG. 10C is a cross-sectional view of the mini coil spring of FIGS. 10A and 10B shown partially compressed in a short pocket.

FIGS. 9C and 10C illustrate another set of tall and short pocketed mini coil springs, which may be used together in any of the comfort layers shown or described herein. FIGS. 9A and 9B show an alternative mini coil spring 60 in an out-of-pocket condition, which may be partially compressed and pocketed to create a tall pocketed mini coil spring 62, shown in FIG. 9C. Tall pocketed mini coil springs 62 may be incorporated into any of the comfort layers shown or described herein, including in any of the tall sections of any of the posturized comfort layers shown or described herein, including the end sections 42 of posturized comfort layer 16. Each tall pocketed mini coil spring 62, shown in detail in FIG. 9C, comprises a mini coil spring 60 and first and second pieces 22, 24 of fabric joined together with a rectangular weld seam 30. As shown in FIG. 9A, each mini coil spring 60 has an out-of-pocket height H5 in its relaxed or non-compressed condition. As shown in FIG. 9B, each mini coil spring 60 has diameter of D1 in its relaxed or non-compressed condition. As shown in FIG. 9C, each mini coil spring 60, when pocketed, creates a tall pocketed mini coil spring 62 having a pocketed height H3.

FIGS. 10A and 10B show a mini coil spring 64 in an out-of-pocket condition, which may be partially compressed and pocketed to create a short pocketed mini coil spring 66, shown in FIG. 10C. Short pocketed mini coil springs 66 may be incorporated into any of the comfort layers shown or described herein, including in any of the short sections of any of the posturized comfort layers shown or described herein, such as the center section 40 of posturized comfort layer 16. Each short pocketed mini coil spring 66, shown in detail in FIG. 10C, comprises a mini coil spring 64 partially compressed between first and second pieces 22, 24 of fabric joined together with a rectangular weld seam 30. As shown in FIG. 10A, each mini coil spring 64 has an out-of-pocket height H5 in its relaxed or non-compressed condition, the same out-of-pocket height as the out-of-pocket height H5 of mini coil spring 60 shown in FIG. 9A. As shown in FIG. 10B, each mini coil spring 64 has diameter D2 in its relaxed or non-compressed condition, greater than the diameter D1 of the mini coil spring 60 shown in FIG. 9B. As shown in FIG. 10C, each mini coil spring 64, when partially compressed and pocketed, creates a short pocketed mini coil spring 66 having a height H4, less than the height H3 of tall pocketed mini coil spring 62 shown in FIG. 9C.

According to one aspect of the invention, within a comfort layer, such as mini coil springs 60, 62, may be made of the same wire. In one embodiment, mini coil springs 60, 62 may be both made of seventeen-gauge wire. However, mini coil springs 60, 62 may be made of any gauge wire, including different gauge wires.

In posturized comfort layer 16, the end sections 42 are firmer than the center section 40 because the pocketed mini coil springs of the end sections 42 are tall pocketed mini coil springs 44 and the pocketed mini coil springs of the center section 40 are short pocketed mini coil springs 46. Any of the other combinations of short and tall pocketed mini coil springs, such as those shown in FIGS. 7C and 8C or FIGS. 9C and 10C, may be incorporated into posturized comfort layer 16, as well as any other comfort layer shown or described herein.

Figure 11A:
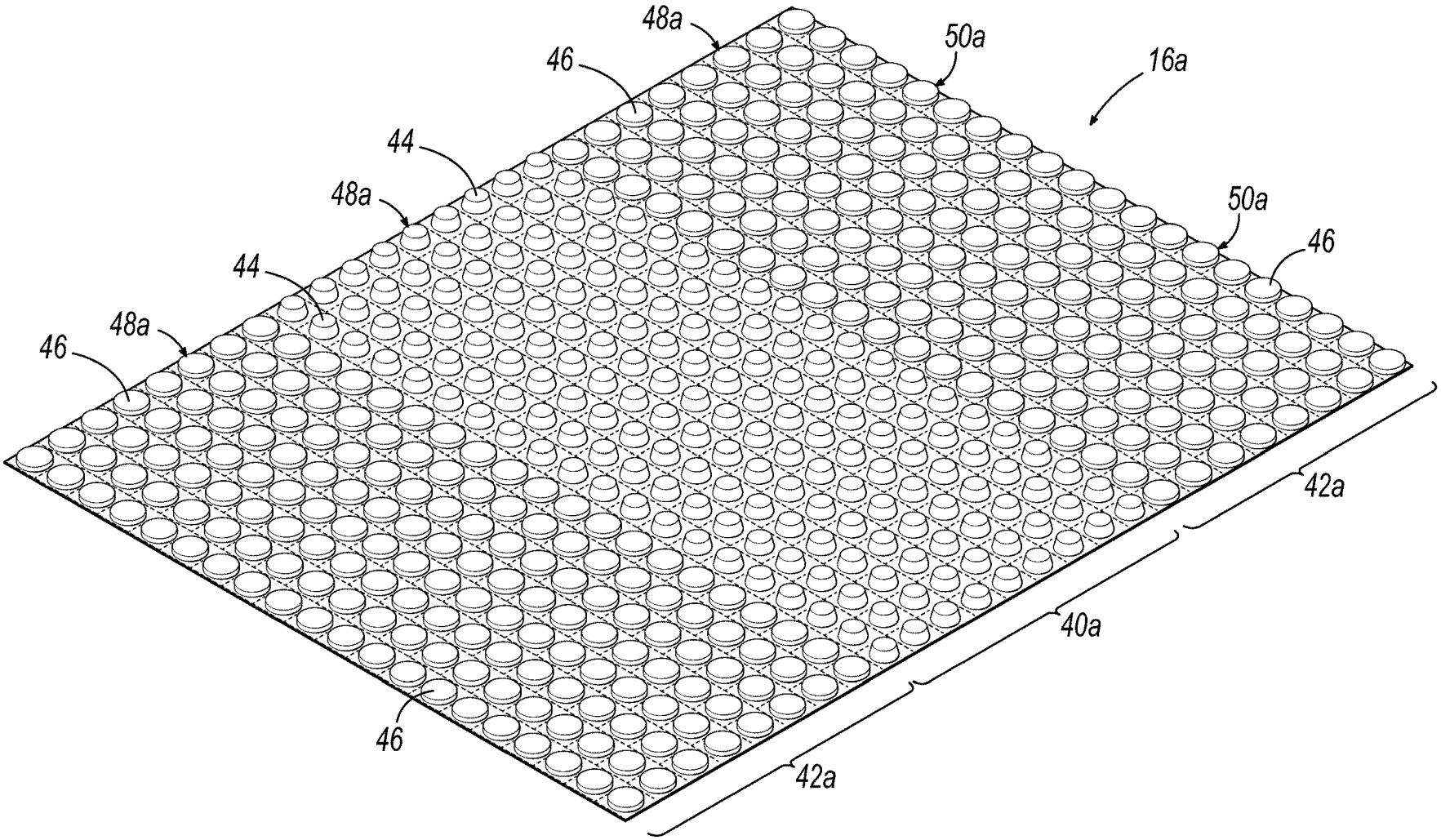
FIG. 11A is a perspective view of another comfort layer, the middle section being a tall section and the end sections being short sections.

FIG. 11A illustrates another posturized comfort layer 16*a* in which the orientation of the pocketed mini coil springs is different than the orientation of the pocketed mini coil springs in posturized comfort layer 16. FIG. 11A illustrates the posturized comfort layer 16*a* having a center section 40*a* and two end sections 42*a* on opposite sides of the center section 40*a*. Each of the three sections 40*a*, 42*a* is generally rectangular shaped and approximately the same size. However, any one of the sections may be a different size than any other section. For example, the end sections 42*a* may be a different size than the middle or center section 40*a*. The drawings are not intended to be limiting.

The center section 40*a* is firmer than the end sections 42*a* because the pocketed mini coil springs of the center section 40*a* are tall pocketed mini coil springs 44 and the pocketed mini coil springs of the end sections 42 are short pocketed mini coil springs 46. Any of the other combinations of short and tall pocketed mini coil springs, such as those shown in FIGS. 7C and 8C or FIGS. 9C and 10C, may be incorporated into posturized comfort layer 16*a*, as well as any other posturized comfort layer shown or described herein.

As best shown in FIG. 11A, the pocketed mini coil springs 44, 46 are arranged in a matrix of aligned transversely extending rows 48*a* extending from side-to-side and longitudinally extending columns 50*a* extending from head-to-foot. Each of the pocketed mini coil springs of the center section 40*a* is illustrated being a tall mini coil spring 46, as described herein and shown in FIGS. 4 and 5C. Each of the pocketed mini coil springs of the end sections 42*a* is illustrated being a short pocketed mini coil spring 46, as described below and shown in FIGS. 4 and 6C. As shown in FIG. 11A, each row 48*a* of short pocketed mini coil springs 46 in the end sections 42*a* is identical. Similarly, each row 48*a* of tall pocketed mini coil springs 44 in the center section 40*a* is identical. The center section 40*a* is taller than the end sections 42*a* because the rows 48*a* of pocketed mini coil springs 44 in the center section 40*a* are taller than the rows 48*a* of pocketed mini coil springs 46 in the end sections 42*a*. Each longitudinally extending column 50*a* of pocketed mini coil springs 44, 46 is identical along the length of the posturized comfort layer 16*a*.

Figure 11B:
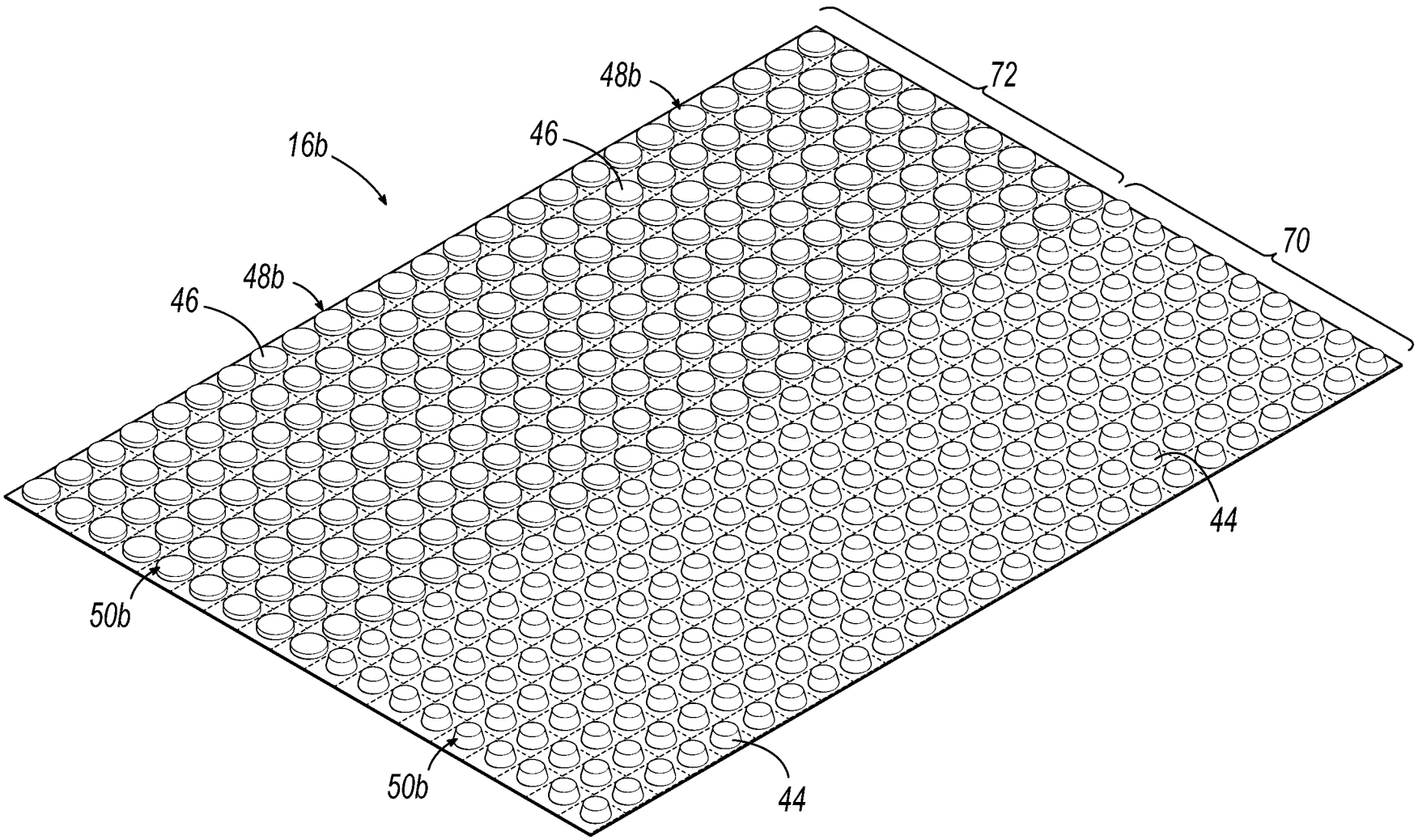
FIG. 11B is a perspective view of another comfort layer having one tall section and one short section.

FIG. 11B illustrates another posturized comfort layer 16*b*. FIG. 11B illustrates the posturized comfort layer 16*b* having a firm section 70 and a soft section 72 side-by-side. Each of the firm and soft sections 70, 72 is generally rectangular and approximately the same size. However, one of the sections 70, 72 may be a different size than the other section. The drawings are not intended to be limiting.

In posturized comfort layer 16*b*, the firm section 70 is firmer than the soft section 72 because the pocketed mini coil springs of the firm section 70 are tall pocketed mini coil springs 44 and the pocketed mini coil springs of the soft section 72 are short pocketed mini coil springs 46. Any of the other combinations of short and tall pocketed mini coil springs, such as those shown in FIGS. 7C and 8C or FIGS. 9C and 10C, may be incorporated into posturized comfort layer 16*b*, as well as any other comfort layer shown or described herein.

As best shown in FIG. 11B, the pocketed mini coil springs 44, 46 are arranged in a matrix of aligned transversely extending rows 48*b* extending from side-to-side and longitudinally extending columns 50*b* extending from head-to-foot. Each of the pocketed mini coil springs of the firm section 70 is illustrated being a tall mini coil spring 44, as described herein and shown in FIGS. 4 and 5C. Each of the pocketed mini coil springs of the soft section 72 is illustrated being a short pocketed mini coil spring 46, as described below and shown in FIGS. 4 and 6C. As shown in FIG. 11B, each column 50*b* of short pocketed mini coil springs 46 in the soft section 72 is identical. Similarly, each column 50*b* of tall pocketed mini coil springs 44 in the firm section 70 is identical, taller than the columns 50 of pocketed mini coil springs 44 in the soft section 72. Each transversely extending row 48*b* of pocketed mini coil springs 44, 46 is identical in the posturized comfort layer 16*b*.

Figure 12:
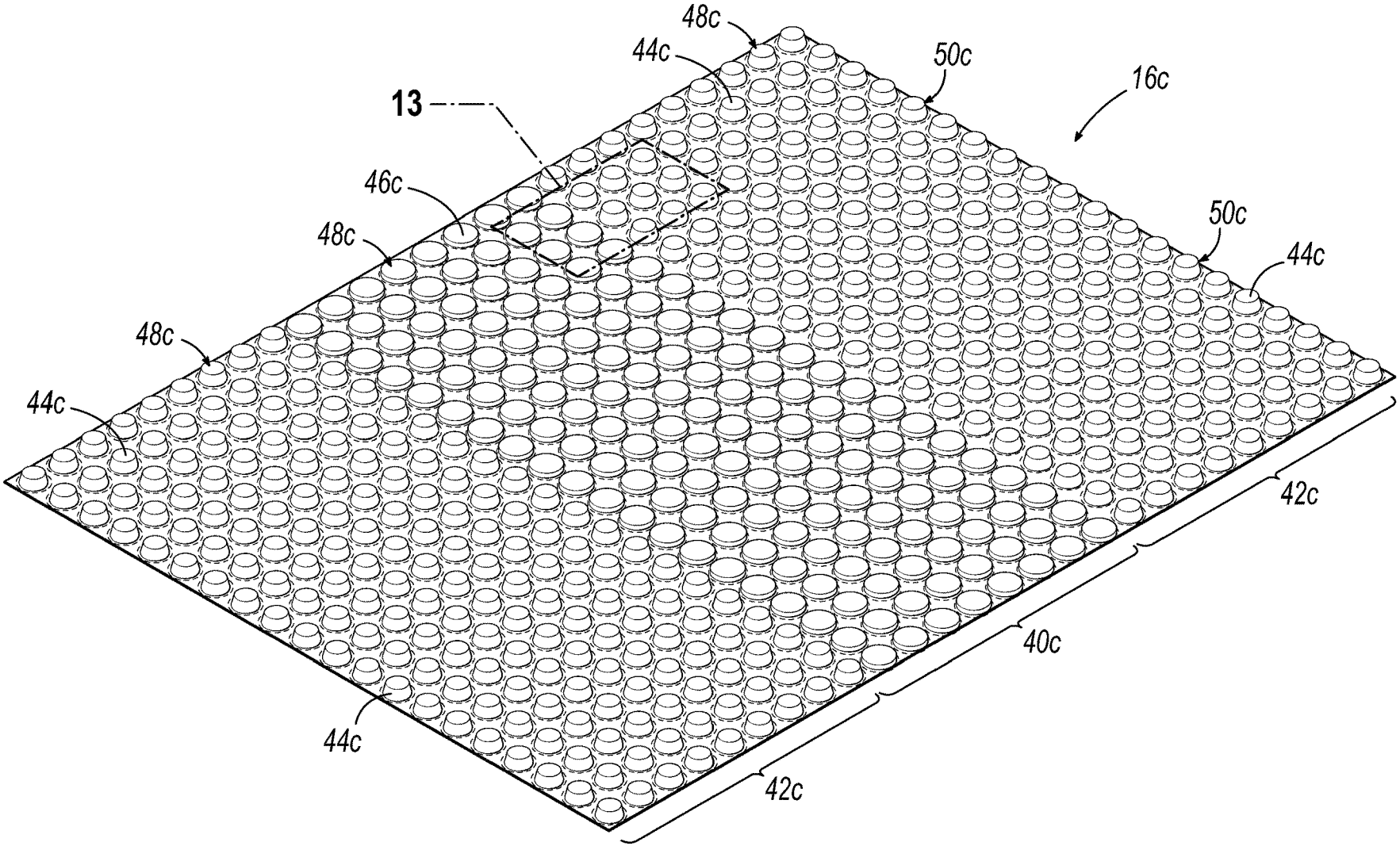
FIG. 12 is a perspective view of another comfort layer made in accordance with the invention.
Figure 13A:
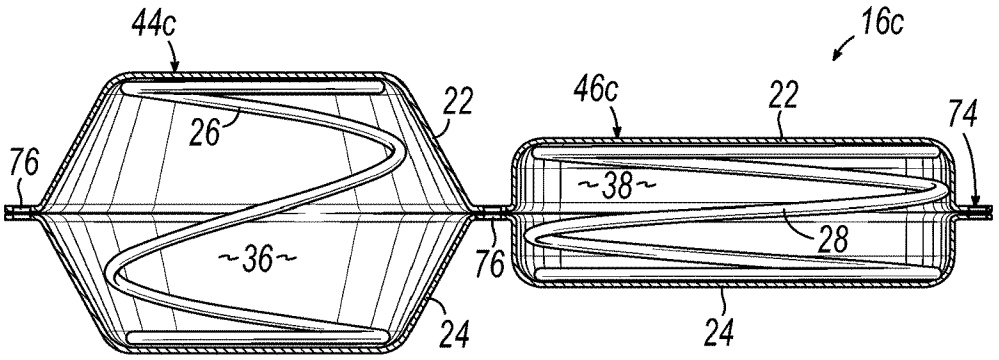
FIG. 13A is a cross-sectional view taken along the line 13A-13A of FIG. 13.
Figure 13:
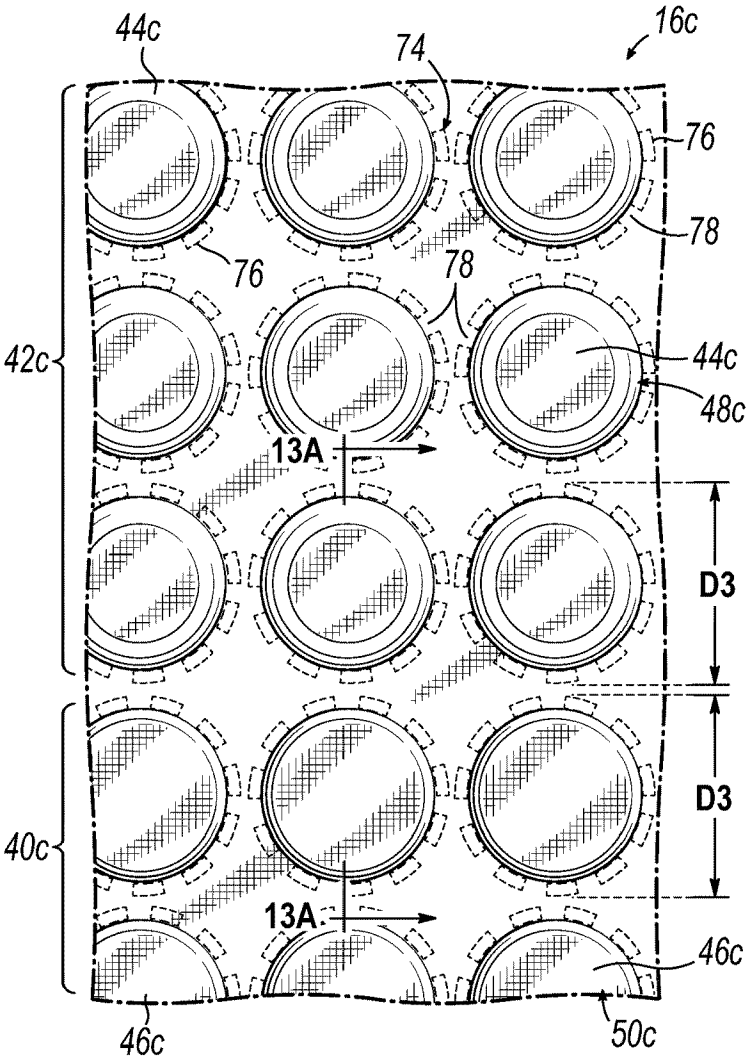
FIG. 13 is a top view of the area 13 of FIG. 12.

FIGS. 12, 13 and 13A illustrate another posturized comfort layer 16*c* having pocketed mini coil springs 44*c*, 46*c* having circular welds, rather than rectangular welds, joining the first and second pieces of fabric 22, 24. FIG. 12 illustrates the posturized comfort layer 16*c* having a center section 40*c* and two end sections 42*c* on opposite sides of the center section 40*c*. Each of the three sections 40*c*, 42*c* is generally rectangular and approximately the same size. However, any one of the sections may be a different size than any other section. For example, the end sections 42*c* may be a different size than the middle or center section 40*c*. The drawings are not intended to be limiting.

In posturized comfort layer 16*c*, the end sections 42*c* are firmer than the center section 40*c* because the pocketed mini coil springs of the end sections 42*c* are tall pocketed mini coil springs 44*c* and the pocketed mini coil springs of the center section 40*c* are short pocketed mini coil springs 46*c*. Any of the other combinations of short and tall pocketed mini coil springs, such as those shown in FIGS. 7C and 8C or FIGS. 9C and 10C, may be incorporated into posturized comfort layer 16*c*, as well as any other comfort layer shown or described herein.

As best shown in FIG. 12, the pocketed mini coil springs 44*c*, 46*c* are arranged in a matrix of aligned transversely extending rows 48*c* extending from side-to-side and aligned longitudinally extending columns 50*c* extending from head-to-foot. Each of the pocketed mini coil springs of the center section 40*c* is illustrated being a short mini coil spring 46*c*, as described herein and shown in FIGS. 12, 13 and 13A. Each of the pocketed mini coil springs of the end sections 42*c* is illustrated being a tall pocketed mini coil spring 44*c*, as described below and shown in FIGS. 12, 13 and 13A. As shown in FIG. 12, each row 48*c* of tall pocketed mini coil springs 44*c* in each of the end sections 42*c* is identical. Similarly, each row 48*c* of short pocketed mini coil springs 46*c* in the center section 40*c* is identical. The rows 48*c* are shorter than the rows 48 of pocketed mini coil springs 44*c* in the end sections 42*c*. Each longitudinally extending column 50*c* of pocketed mini coil springs is identical, having both pocketed mini coil springs 44*c*, 46*c*.

FIG. 13A illustrates the components of one embodiment of comfort layer 16*c* shown in FIGS. 12 and 13. The comfort layer 16*c* comprises a first or upper piece of fabric 22 and a second or lower piece of fabric 24 with a plurality of mini coil springs 26, 28 therebetween. The fabric pieces 22, 24 are joined together with circular weld seams 74, each circular seam 74 surrounding a mini coil spring 26, 28. Each circular seam 74 comprises multiple arced or curved weld segments 76 with gaps 78 therebetween. The first and second pieces of fabric 22, 24 are joined together along each arced or curved weld segment 76 of each circular seam 74. The first and second pieces of fabric 22, 24 are not joined together along each gap 78 between adjacent weld segments 76 of each circular seam 74. The curved weld segments 76 are strategically placed around a mini coil spring 26, 28 and create the circular seam 74. The two pieces of fabric 22, 24, in combination with one of the circular weld seams 74, define a cylindrical-shaped pocket 36*c*, 38*c* inside of which is at least one mini coil spring 26, 28. See FIGS. 13 and 13A.

During the welding process, the mini coil springs 26, 28 may be at least partially compressed before pocket 36*c*, 38*c* is closed and thereafter. If desired, resilient members other than mini coil springs, such as foam members, may be used and any embodiment disclosed or shown herein. Alternatively, resilient members made of resilient material, other than foam which returns to its original configuration after a load is removed from the material, may be used inside the pockets in any embodiment disclosed or shown herein.

The embodiment of posturized comfort layer 16*c* shown in FIGS. 12, 13 and 13A illustrates all the circular weld seams 74 being the same diameter D3. The difference in the height of the pocketed mini coil springs 44*c*, 46*c* is due to the different mini coil springs being inside the pockets.

Although the drawings show a certain size of the curved weld segments 76 of circular weld seams 74, the size of the curved weld segments 76 of circular weld seams 74 are not intended to be limited by the illustrations; they may be any desired size. Similarly, although the drawings show the circular weld seams 74 having a certain diameter D3, the diameter of the illustrated circular weld seams 74 is not intended to be limiting.

Figure 14:
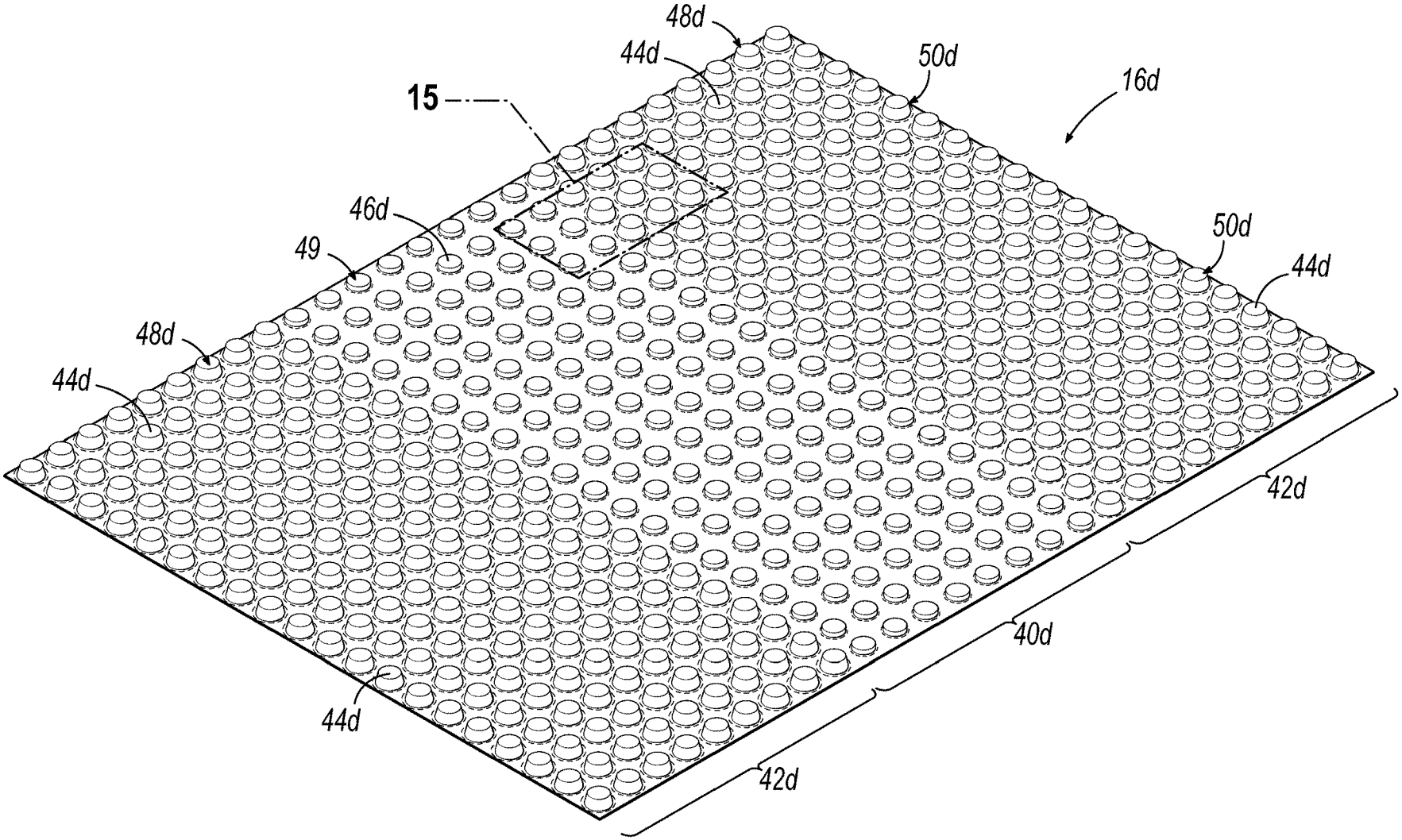
FIG. 14 is a perspective view of another comfort layer made in accordance with the invention which may be used in any bedding or seating product.

FIGS. 14, 15, 16A-16C and 17A-17C illustrate another posturized comfort layer 16*d* having identical mini coil springs 80 throughout, but circular welds of different diameters D3 and D4 joining the first and second pieces of fabric 22, 24. FIG. 14 illustrates the posturized comfort layer 16*d* having a center section 40*d* and two end sections 42*d* on opposite sides of the center section 40*d*. Each of the three sections 40*d*, 42*d* is generally rectangular shaped and approximately the same size. However, any one of the sections may be a different size than any other section. For example, the end sections 42*d* may be a different size than the middle or center section 40*d*. The drawings are not intended to be limiting.

In posturized comfort layer 16*d*, the end sections 42*d* are firmer than the center section 40*d* because the pocketed mini coil springs of the end sections 42*d* are tall pocketed mini coil springs 44*d* and the pocketed mini coil springs of the center section 40*d* are short pocketed mini coil springs 46*d*.

As best shown in FIG. 14, the tall pocketed mini coil springs 44*d* of each end section 42*d* are arranged in a matrix of aligned transversely extending rows 48*d* extending from side-to-side and aligned longitudinally extending columns 50*d* extending from head-to-foot. Likewise, the short pocketed mini coil springs 46*d* of the center section 40*d* are arranged in a matrix of aligned transversely extending rows 49 extending from side-to-side. As best shown in FIG. 14, each aligned longitudinally extending column 50*d* extending from head-to-foot is identical and has a group or set of short pocketed mini coil springs 46*d* between groups or sets of tall pocketed mini coil springs 44*d*.

As shown in FIG. 14, each row 48*d* of tall pocketed mini coil springs 44*d* in each of the end sections 42*d* is identical. Similarly, each row 49 of short pocketed mini coil springs 46*d* in the center section 40*d* is identical. The rows 49 have a different height (shorter) than the rows 48*d* of pocketed mini coil springs 44*d* in the end sections 42*d*.

Figure 16A:
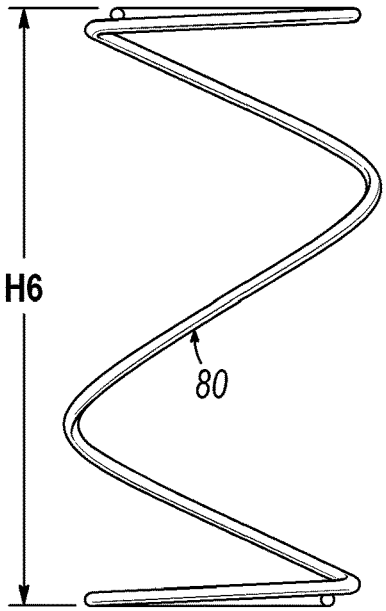
FIG. 16A is a side elevational view of a mini coil spring which may be used in any pocket of any comfort layer shown or described herein.
Figure 16B:
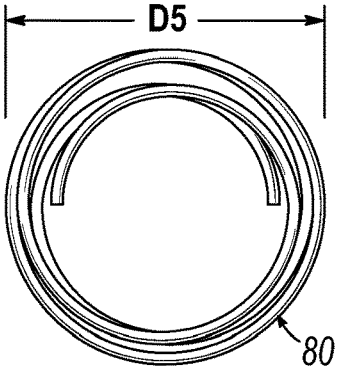
FIG. 16B is a top view of the mini coil spring of FIG. 16A.
Figure 16C:
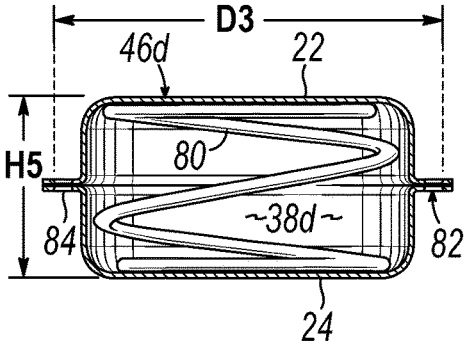
FIG. 16C is a cross-sectional view taken along the line 16C-16C of FIG. 15.

Each of the pocketed mini coil springs of the center section 40*d* is illustrated being a short pocketed mini coil spring 46*d*, as described herein and shown in FIGS. 16A, 16B and 16C. Each of the pocketed mini coil springs 44*d* of the end sections 42*d* is illustrated being a tall pocketed mini coil spring 44*d*, as described below and shown in FIGS. 17A, 17B and 17C.

Figure 15:
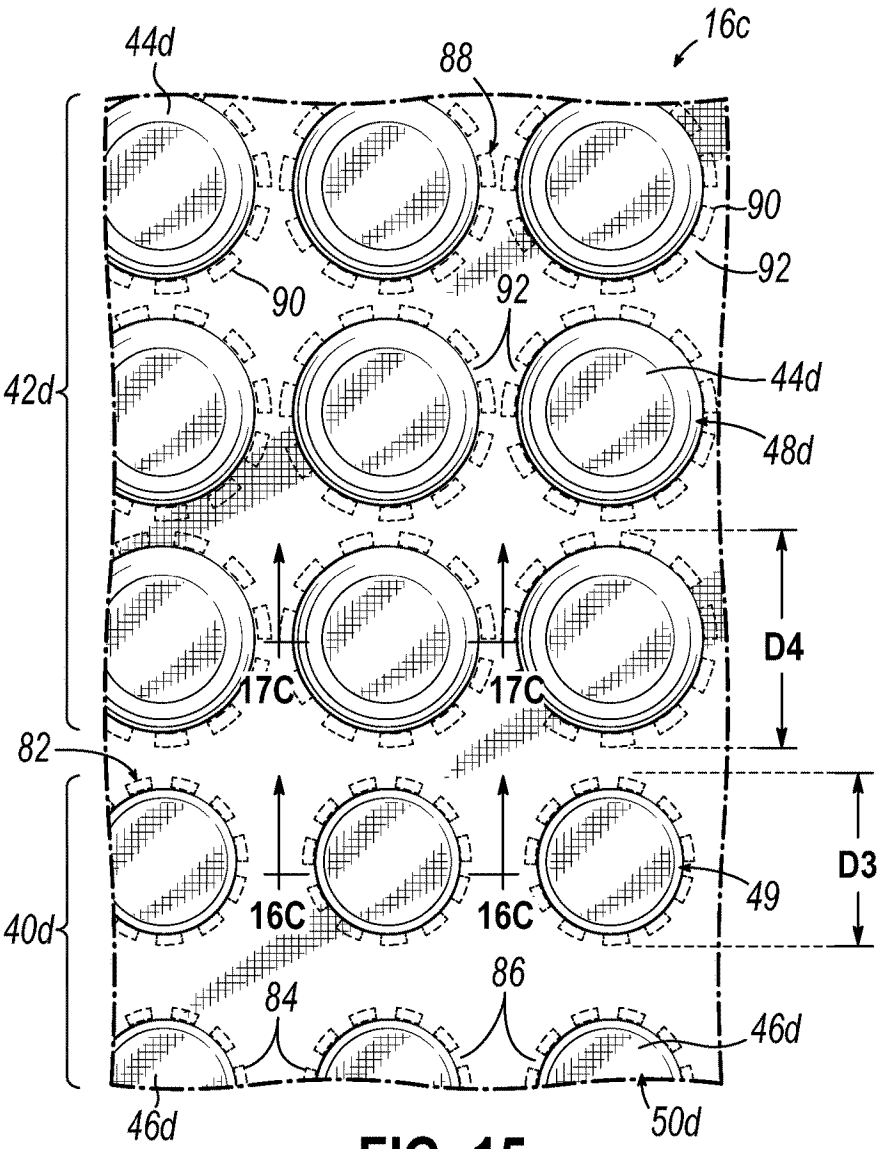
FIG. 15 is a top view of the area 15 of FIG. 14.

FIG. 16C illustrates the components of one of the short pocketed mini coil springs 46*d*. The short pocketed mini coil spring 46*d* comprises a first or upper piece of fabric 22 and a second or lower piece of fabric 24 with a partially compressed mini coil spring 80 therebetween. The fabric pieces 22, 24 are joined together with circular weld seams 82. As best shown in FIG. 15, each circular seam 82 has a diameter D3 and surrounds a partially compressed mini coil spring 80. As shown in FIG. 16A, each mini coil spring 80 has an out-of-pocket height H6 in its relaxed or non-compressed condition. As shown in FIG. 16B, each mini coil spring 80 has diameter of D5 in its relaxed or non-compressed condition.

As best seen in FIG. 15, each small circular seam 82 comprises multiple arced or curved weld segments 84 with gaps 86 therebetween. The first and second pieces of fabric 22, 24 are joined together along each arced or curved weld segment 84 of each small circular seam 82. The first and second pieces of fabric 22, 24 are not joined together along each gap 86 between adjacent weld segments 84 of each small circular seam 82. The curved weld segments 84 are strategically placed around a mini coil spring 80 and create the small circular seam 82. The two pieces of fabric 22, 24, in combination with one of the small circular weld seams 82, define a cylindrical-shaped pocket 38*d* inside of which is at least one partially compressed mini coil spring 80. See FIG. 16C.

Figure 17A:
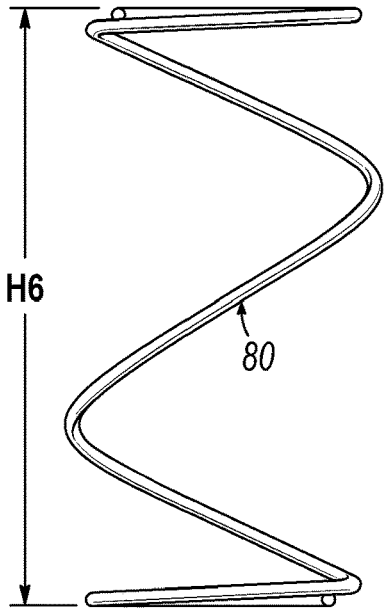
FIG. 17A is a side elevational view of the mini coil spring of FIG. 16A.
Figure 17B:
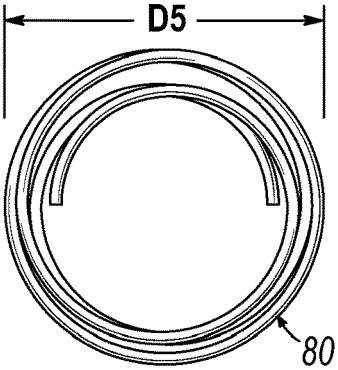
FIG. 17B is a top view of the mini coil spring of FIG. 17A.
Figure 17C:
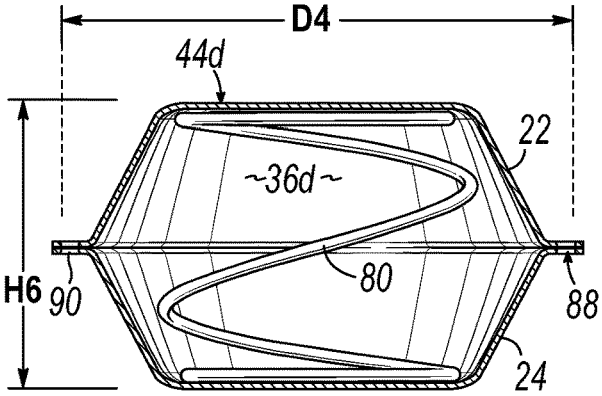
FIG. 17C is a cross-sectional view taken along the line 17C-17C of FIG. 15.

FIG. 17C illustrates the components of one of the tall pocketed mini coil springs 44*d*. The tall pocketed mini coil spring 44*d* comprises a first or upper piece of fabric 22 and a second or lower piece of fabric 24 with a partially compressed mini coil spring 80 therebetween. The fabric pieces 22, 24 are joined together with large circular weld seams 88. As best shown in FIG. 15, each large circular seam 88 has a diameter D4, greater than the diameter D3 of the small circular weld seams 82 of the short pocketed mini coil springs 46*d*. Each large circular seam 88 surrounds a partially compressed mini coil spring 80. As shown in FIG. 17A, each mini coil spring 80 has an out-of-pocket height H6 in its relaxed or non-compressed condition. As shown in FIG. 17B, each mini coil spring 80 has diameter of D5 in its relaxed or non-compressed condition.

As best seen in FIG. 15, each circular seam 88 comprises multiple arced or curved weld segments 90 with gaps 92 therebetween. The first and second pieces of fabric 22, 24 are joined together along each arced or curved weld segment 90 of each circular seam 88. The first and second pieces of fabric 22, 24 are not joined together along each gap 92 between adjacent weld segments 90 of each circular seam 88. The curved weld segments 90 are strategically placed around a mini coil spring 80 and create the circular seam 88. The two pieces of fabric 22, 24, in combination with one of the circular weld seams 88, define a cylindrical-shaped pocket 36*d* inside of which is at least one partially compressed mini coil spring 80. See FIG. 17C.

During the welding process, the mini coil springs 80 may be at least partially compressed before pocket 36*d*, 38*d* is closed and thereafter. If desired, resilient members other than mini coil springs, such as foam members, may be used. Alternatively, resilient members made of resilient material, other than foam which returns to its original configuration after a load is removed from the material, may be used inside the pockets.

The embodiment of posturized comfort layer 16*d* shown in FIGS. 14, 15, 16A-16C and 17A-17C illustrates small and large circular weld seams 82, 88, respectively, of different diameters. The difference in the height of the pocketed mini coil springs 44*d*, 46*d* in the different sections is due to the different diameters of the circular weld seams, the mini coil springs inside the pockets being identical.

Although the drawings show a certain size of the curved weld segments 84, 90 of circular weld seams 82, 88, respectively, the size of the curved weld segments 84, 90 of circular weld seams 82, 88, respectively, are not intended to be limited by the illustrations; they may be any desired size. Similarly, although the drawings show the circular weld seams 82, 88 having a certain diameters D3, D4, respectively, the diameter of the illustrated circular weld seams 82, 88 is not intended to be limiting.

Although the posturized comfort layer 16*d* shows a center section 40*d* having a softer feel than the feel of the end sections 42*d* because the circular weld seams 82 of the short pocketed mini coil springs 46*d* have a smaller diameter than the circular weld seams 88 of the tall pocketed mini coil springs 46*d*, it is within the scope of the invention that any comfort layer shown or described herein may incorporate different diameter weld seams with the same mini coil springs to create pocketed mini coil springs of different heights and different firmness. For example, a posturized comfort layer like the posturized comfort layer 16*a* shown in FIG. 11A or a posturized comfort layer like the posturized comfort layer 16*b* shown in FIG. 11B may be created using circular weld seams of different diameters with the same mini coil springs.

Figure 18A:
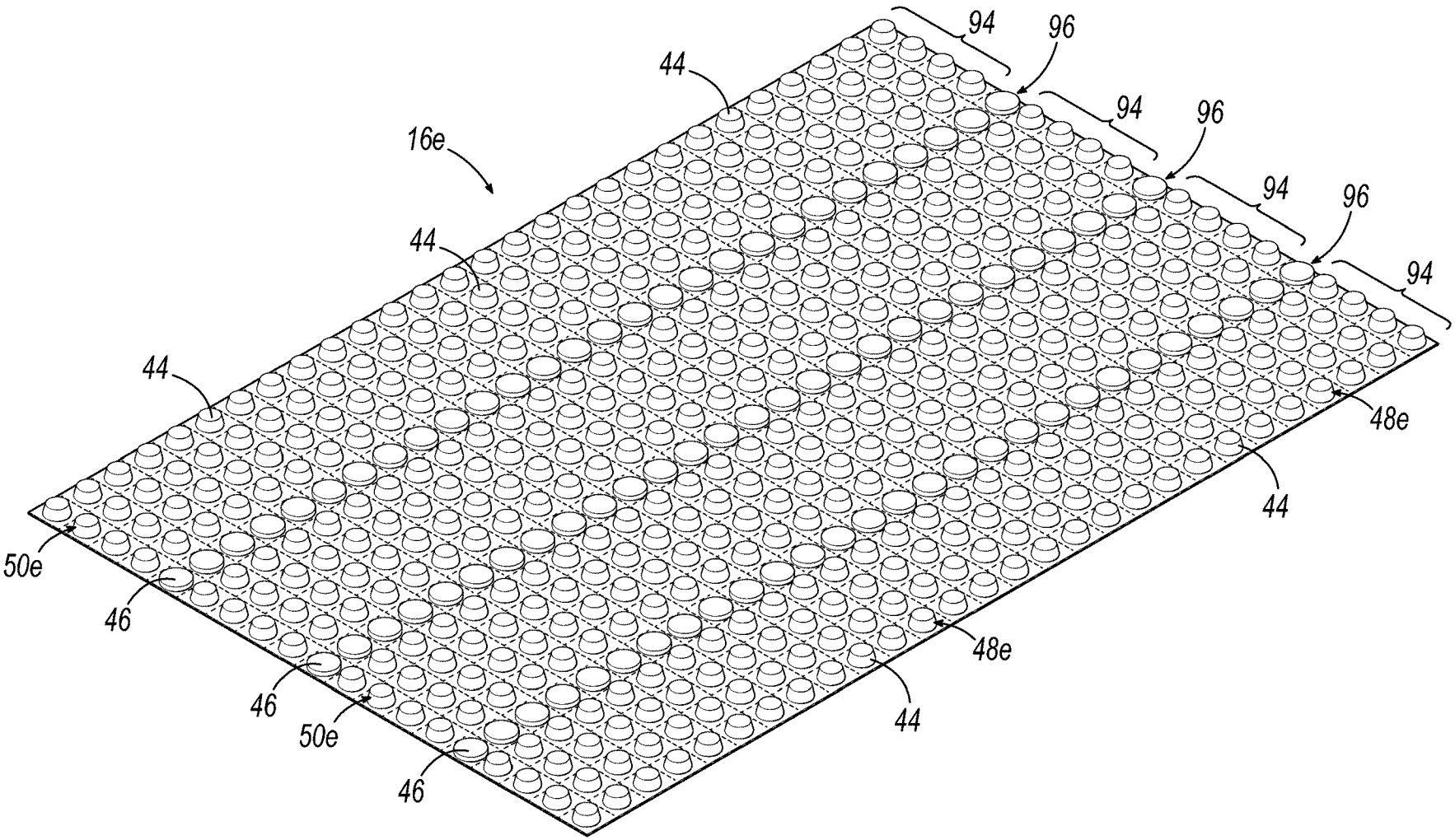
FIG. 18A is a perspective view of another comfort layer made in accordance with the invention which may be used in any bedding or seating product.

FIG. 18A illustrates another posturized comfort layer 16*e* having four tall sections 94 and three short sections 96, each of the sections 94, 96 extending the full length of the posturized comfort layer 16*e*. Adjacent tall sections 94 are separated by a longitudinally extending short section 96 of short pocketed mini coil springs 46. The pocketed mini coil springs of each of the tall sections 94 are tall pocketed mini coil springs 44, thus resulting in firmer sections than the short sections 96 of the posturized comfort layer 16*e*. Each of the tall sections 94 is generally rectangular shaped, comprises multiple columns and is approximately the same size. However, any one of the sections may be a different size than any other section. For example, any of the tall sections 94 may be a different size than any other tall section.

Although FIG. 18A shows each short section 96 comprising only one longitudinally extending column of short pocketed mini coil springs 46 between adjacent tall sections 94, one or more short sections 96 may comprise two or more longitudinally extending columns of short pocketed mini coil springs 46 between adjacent tall sections 94. Similarly, although FIG. 18A shows each tall section 94 comprising four columns of tall pocketed mini coil springs 44, each tall section may comprise any desired number of columns of tall pocketed mini coil springs. Although FIG. 18A shows four tall sections 94 and three short sections 96, such a posturized comfort layer may have any number of tall sections and short sections. The sections may extend from side-to-side rather than from head-to-foot as shown in FIG. 18A, in which case each section would comprise multiple rows of pocketed mini coil springs of a desired height. The drawings are not intended to be limiting.

As best shown in FIG. 18A, each longitudinally extending column of short pocketed mini coil springs 46 between adjacent tall sections 94 is known in the art as a "spacer" column. One purpose/benefit of the spacer column(s) is the manufacturer of the comfort layer uses the same amount of fabric material along the entire width and length of the comfort layer 16*e* which results in a rectangular comfort layer, within normal manufacturing tolerances. For manufacturing purposes, a comfort layer which is rectangular, within normal manufacturing tolerances, is more desirable than a product which is not so evenly dimensioned. This benefit of the spacer column(s) or row(s) applies to any of the embodiments shown or described herein, including the comfort layers shown in FIGS. 18A-18D, even if the comfort layer only has one spacer row or column of spacer pocketed springs. This benefit applies regardless of the height and direction and length of the spacer column(s) or row(s).

As best shown in FIG. 18A, the pocketed mini coil springs 44, 46 are arranged in a matrix of aligned transversely extending rows 48*e* extending from side-to-side and longitudinally extending columns 50*e* extending from head-to-foot. In this embodiment, each of the pocketed mini coil springs along each of the columns is identical. However, the pocketed mini coil springs within the columns of the tall sections are different than the pocketed mini coil springs within the columns of the short sections. Each of the pocketed mini coil springs of each of the tall sections 94 is illustrated being a tall pocketed mini coil spring 44, as described herein and shown in FIG. 5C. Each of the pocketed mini coil springs of each short section 96 is illustrated being a short pocketed mini coil spring 46, as described herein and shown in FIG. 6C. In place of tall pocketed mini coil springs 44, tall pocketed mini coil springs, like tall pocketed mini coil springs 56 shown in FIG. 7C or tall pocketed mini coil springs 62 shown in FIG. 9C, may be used in any of the tall sections 94 of posturized comfort layer 16*e*. Similarly, in place of short pocketed mini coil springs 46, short pocketed mini coil springs, like short pocketed mini coil springs 58 shown in FIG. 8C or short pocketed mini coil springs 66 shown in FIG. 10C, may be used in any of the short sections 96 of posturized comfort layer 16*e*.

Although FIG. 18A illustrates the pocketed mini coil springs having rectangular weld seams, circular weld seams may be incorporated into the pocketed mini coil springs in this or any embodiment shown or described herein.

Although FIG. 18A illustrates the sections extending the full length of the comfort layer longitudinally or from head-to-foot, the sections may extend the full width of the comfort layer transversely or from side-to-side. In such an embodiment, each of the pocketed mini coil springs of each of the rows would identical. The pocketed mini coil springs within the rows of the tall sections would be different than the pocketed mini coil springs within the rows of the short sections.

Figure 18B:
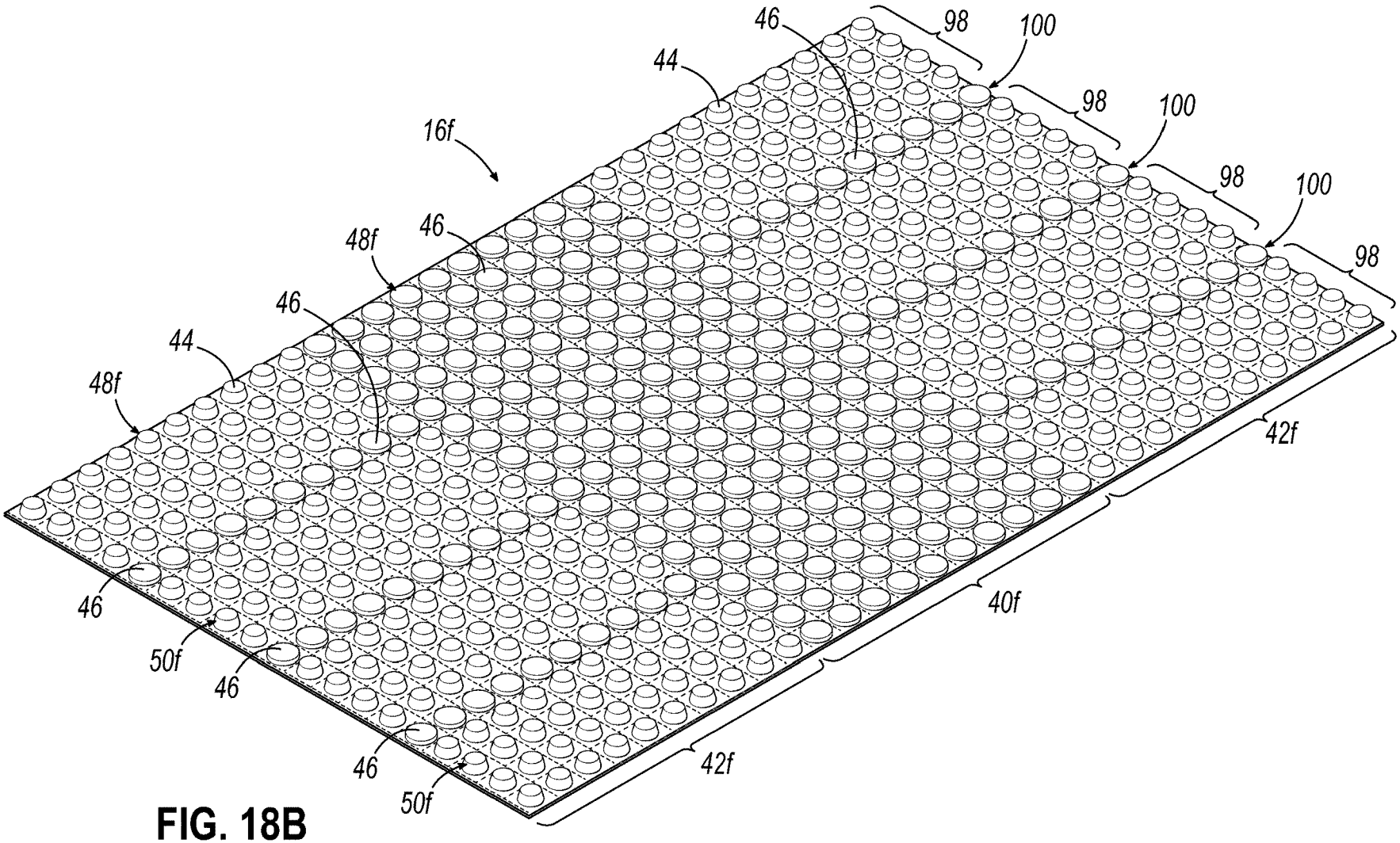
FIG. 18B is a perspective view of another comfort layer made in accordance with the invention which may be used in any bedding or seating product.

FIG. 18B illustrates another posturized comfort layer 16*f* having a center section 40*f* and two end sections 42*f* on opposite sides of the center section 40*f*. Each of the three sections 40*f*, 42*f* is generally rectangular shaped and approximately the same size. However, any one of the sections may be a different size than any other section. For example, the end sections 42*f* may be a different size than the center section 40*f*. The drawings are not intended to be limiting.

Each of the end sections 42*f* is illustrated having four tall sections 98, adjacent tall sections 98 being separated by a longitudinally extending short section 100 of short pocketed mini coil springs 46. The pocketed mini coil springs of each of the tall sections 98 are tall pocketed mini coil springs 44, thus resulting in firmer sections than the short sections 100 of each of the end sections 100 of posturized comfort layer 16*f*. Each of the tall sections 98 of each end section 42*f* is generally rectangular shaped and approximately the same size. However, any section may be a different size than any other section. For example, any one of the tall sections 98 may be a different size than any other tall section in one or both end sections 42*f*.

Although FIG. 18B shows each short section 100 of each end section 42*f* comprising only one longitudinally extending partial column of short pocketed mini coil springs 46 between adjacent tall sections 98, one or more short sections 100 may comprise two or more longitudinally extending partial columns of short pocketed mini coil springs 46 between adjacent tall sections 98 in one or both end sections 42*f*. As shown in FIG. 18B, each longitudinally extending partial column(s) 100 of short pocketed mini coil springs 46 between adjacent tall sections 98 is known in the art as a spacer partial column(s) with the benefits described above. Although FIG. 18B shows each tall section 98 comprising four partial columns of tall pocketed mini coil springs 44, each tall section 98 may comprise any desired number of partial columns of tall pocketed mini coil springs. The drawings are not intended to be limiting.

As best shown in FIG. 18B, the pocketed mini coil springs 44, 46 are arranged in a matrix of aligned transversely extending rows 48*f* extending from side-to-side and longitudinally extending columns 50*f* extending from head-to-foot. Each of the pocketed mini coil springs of each of the end sections 42*f* is illustrated being a tall mini coil spring 44, as described herein and shown in FIG. 5C, except for the pocketed mini coil springs 46 of the short sections 100 within each end section 42*f*. Each of the pocketed mini coil springs of each short section 100 and is illustrated being a column of short pocketed mini coil springs 46, as described herein and shown in FIG. 6C. In place of tall pocketed mini coil springs 44, tall pocketed mini coil springs, like tall pocketed mini coil springs 56 shown in FIG. 7C or tall pocketed mini coil springs 62 shown in FIG. 9C, may be used in any of the tall sections 94 of posturized comfort layer 16*e*. Similarly, in place of short pocketed mini coil springs 46, short pocketed mini coil springs, like short pocketed mini coil springs 58 shown in FIG. 8C or short pocketed mini coil springs 66 shown in FIG. 10C, may be used in any of the short sections 100 or 40*f* of posturized comfort layer 16*f*. As best shown in FIG. 18B, each transversely extending row 48*f* of each end section 42*f* of pocketed mini coil springs is identical and comprises short and tall pocketed mini coil springs 44, 46. Each transversely extending row 48*f* of center section 40*f* of pocketed mini coil springs is identical and comprises solely short pocketed mini coil springs 46.

Although FIG. 18B illustrates the pocketed mini coil springs having rectangular weld seams, circular weld seams may be incorporated into the pocketed mini coil springs in this or any embodiment shown or described herein. Although FIG. 18B illustrates only end sections 42*f* having spacer partial columns, it is within the scope of the invention that only center section 40*f* have spacer partial columns and end sections 42*f* lack spacer partial columns.

Figure 18C:
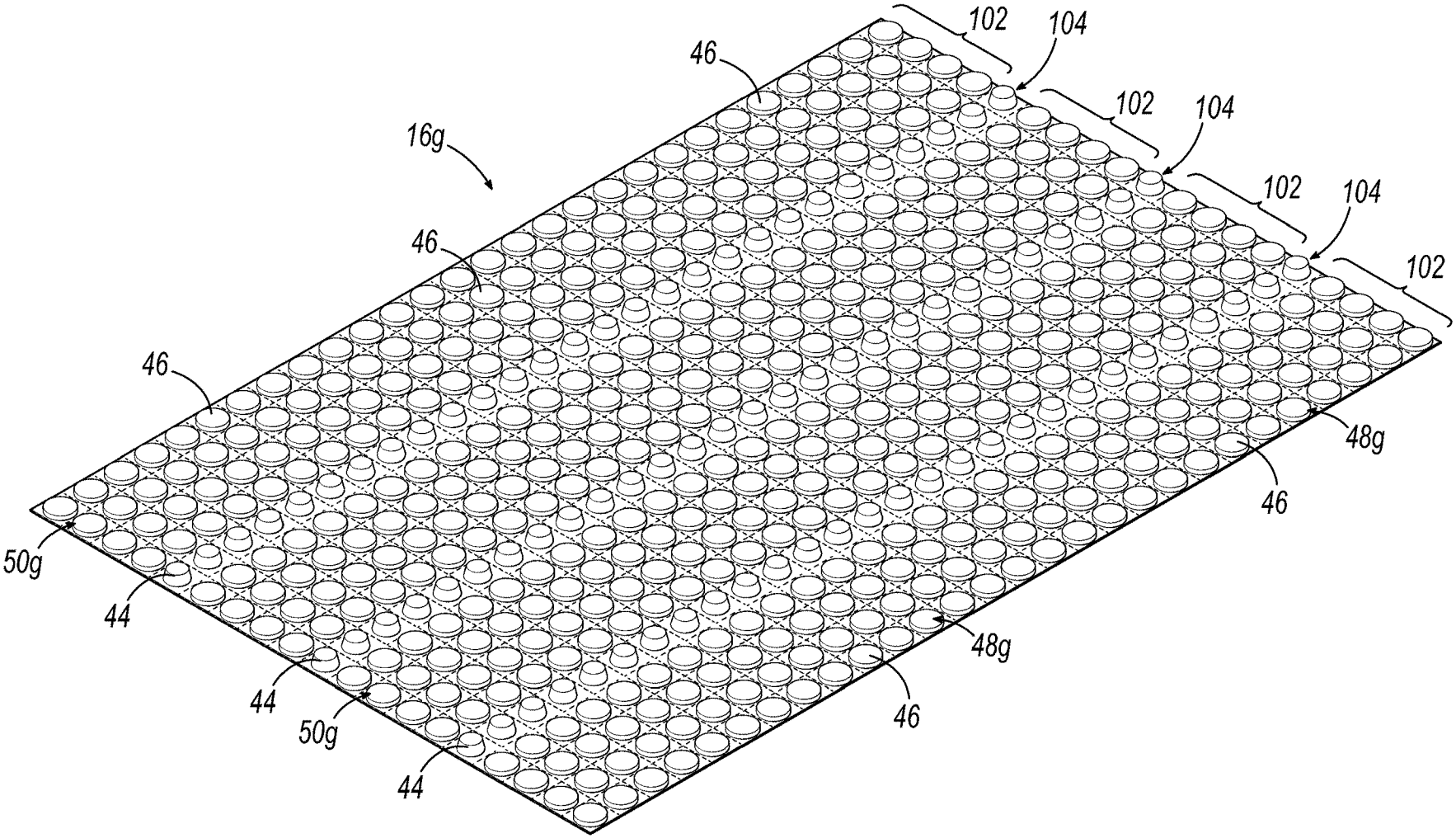
FIG. 18C is a perspective view of another comfort layer made in accordance with the invention which may be used in any bedding or seating product.

FIG. 18C illustrates another posturized comfort layer 16*g* having four short sections 102 and three tall sections 104, each of the sections 102, 104 extending the full length of the posturized comfort layer 16*g*. Adjacent short sections 102 are separated by a longitudinally extending tall section 104 of tall pocketed mini coil springs 44. The pocketed mini coil springs of each of the short sections 102 are short pocketed mini coil springs 46, thus resulting in softer sections than the tall sections of the posturized comfort layer 16*g*. Each of the short sections 102 is generally rectangular shaped, comprises multiple columns and is approximately the same size. However, any one of the sections may be a different size than any of the other sections. For example, any one of the short sections 102 may be a different size than any other short section.

Although FIG. 18C shows each tall section 104 comprising only one longitudinally extending column of tall pocketed mini coil springs 44 between adjacent short sections 102, one or more tall sections 104 may comprise two or more longitudinally extending columns of tall pocketed mini coil springs 44 between adjacent short sections 102. As shown in FIG. 18C, each longitudinally extending column (s) of tall pocketed mini coil springs 44 between adjacent short sections 102 is known in the art as a spacer column(s) with the benefits described herein. Similarly, although FIG. 18C shows each short section 102 comprising four columns of short pocketed mini coil springs 46, each short section may comprise any desired number of columns of short pocketed mini coil springs. Although FIG. 18C shows four short sections 102 and three tall sections 104, such a posturized comfort layer may have any number of tall sections and short sections. The sections may extend from side-to-side rather than from head-to-foot as shown in FIG. 18C, in which case each section would comprise multiple rows of pocketed mini coil springs of a desired height. The drawings are not intended to be limiting.

As best shown in FIG. 18C, the pocketed mini coil springs 44, 46 are arranged in a matrix of aligned transversely extending rows 48*g* extending from side-to-side and longitudinally extending columns 50*g* extending from head-to-foot. In this embodiment, each of the pocketed mini coil springs along each of the columns is identical. However, the pocketed mini coil springs within the columns of the tall sections are different than the pocketed mini coil springs within the columns of the short sections. Each of the pocketed mini coil springs of each of the short sections 102 is illustrated being a short mini coil spring 46, as described herein and shown in FIG. 6C. Each of the pocketed mini coil springs of each tall section 104 is illustrated being a column of tall pocketed mini coil springs 44, as described herein and shown in FIG. 5C. In place of tall pocketed mini coil springs 44, tall pocketed mini coil springs, like tall pocketed mini coil springs 56 shown in FIG. 7C or tall pocketed mini coil springs 62 shown in FIG. 9C, may be used in any of the tall sections 104 of posturized comfort layer 16*g*. Similarly, in place of short pocketed mini coil springs 46, short pocketed mini coil springs, like short pocketed mini coil springs 58 shown in FIG. 8C or short pocketed mini coil springs 66 shown in FIG. 10C, may be used in any of the short sections 102 of posturized comfort layer 16*g*.

Although FIG. 18C illustrates the pocketed mini coil springs having rectangular weld seams, circular weld seams may be incorporated into the pocketed mini coil springs in this or any embodiment shown or described herein.

Although FIG. 18C illustrates the sections extending the full length of the comfort layer longitudinally or from head-to-foot, the sections may extend the full width of the comfort layer transversely or from side-to-side. In such an embodiment, each of the pocketed mini coil springs of each of the rows would identical. The pocketed mini coil springs within the rows of the tall sections would be different than the pocketed mini coil springs within the rows of the short sections.

Figure 18D:
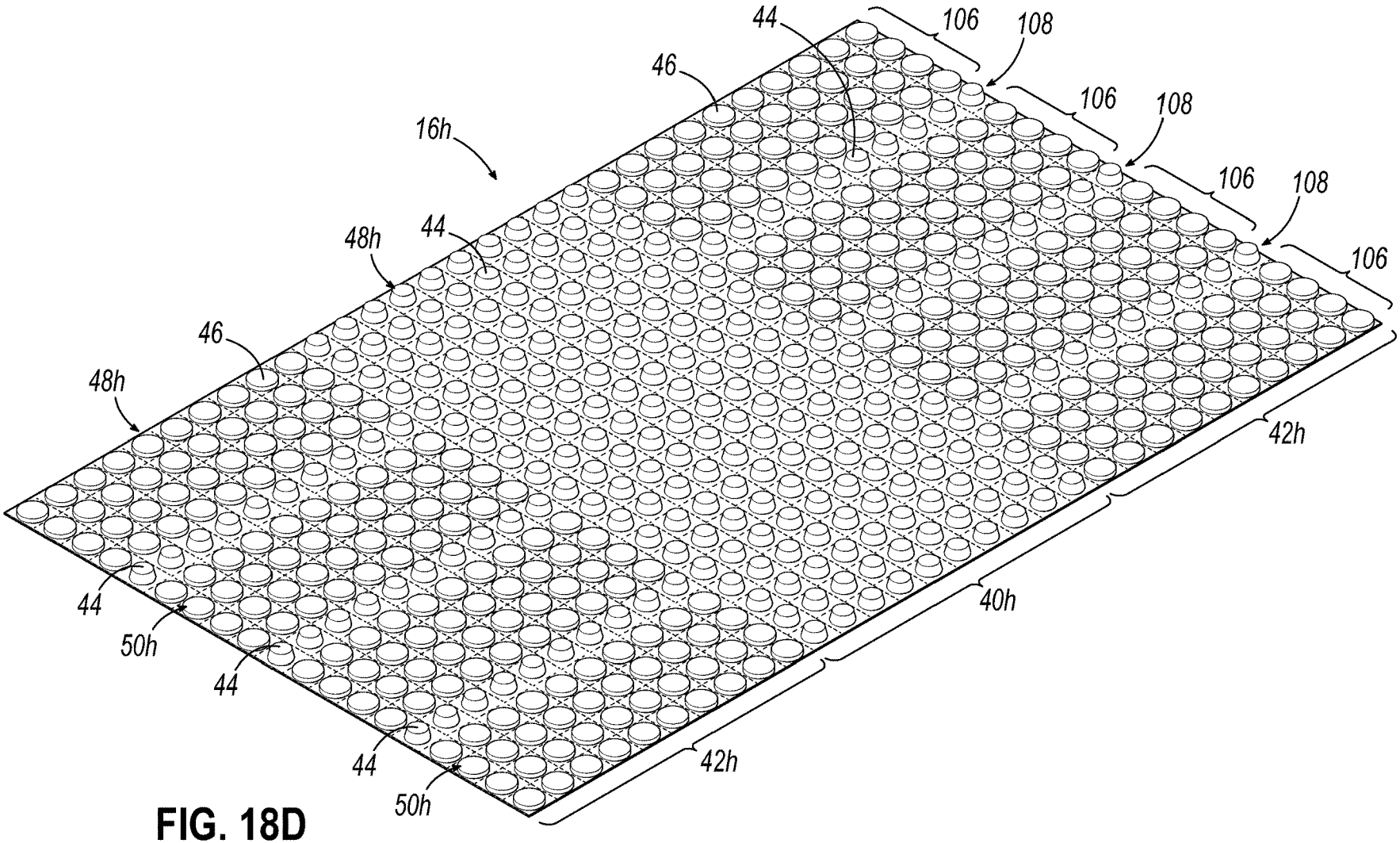
FIG. 18D is a perspective view of another comfort layer made in accordance with the invention which may be used in any bedding or seating product.

FIG. 18D illustrates another posturized comfort layer 16*h* having a center section 40*h* and two end sections 42*h* on opposite sides of the center section 40*h*. Each of the three sections 40*h*, 42*h* is generally rectangular shaped and approximately the same size. However, any one of the sections may be a different size than any of the other sections. For example, the end sections 42*h* may be a different size than the center section 40*h*. The drawings are not intended to be limiting.

Each of the end sections 42*h* is illustrated having four short sections 106, adjacent short sections 106 being separated by a longitudinally extending tall section 108 of tall pocketed mini coil springs 44. The pocketed mini coil springs of each of the tall sections 108 are tall pocketed mini coil springs 44 thus resulting in firmer sections than the short sections 106 of the end sections 42*h* of posturized comfort layer 16*h*. Each of the short sections 106 of each end section 42*h* is generally rectangular shaped and approximately the same size. However, any one of the short sections 106 may be a different size than any other short section in one or both end sections 42*h*.

Although FIG. 18D shows each tall section 108 of each end section 42*h* comprising only one longitudinally extending partial column of tall pocketed mini coil springs 44 between adjacent short sections 106, one or more tall sections 108 may comprise two or more longitudinally extending partial columns of tall pocketed mini coil springs 44 between adjacent short sections 106 in one or both end sections 42*h*. As shown in FIG. 18D, each longitudinally extending partial column(s) of tall pocketed mini coil springs 44 between adjacent short sections 106 is known in the art as a spacer partial column(s) with the benefits described above. Similarly, although FIG. 18D shows each short section 106 comprising four partial columns of short pocketed mini coil springs 46, each short section may comprise any desired number of partial columns of short pocketed mini coil springs. The drawings are not intended to be limiting.

As best shown in FIG. 18D, the pocketed mini coil springs 44, 46 are arranged in a matrix of aligned transversely extending rows 48*h* extending from side-to-side and longitudinally extending columns 50*h* extending from head-to-foot. Each of the pocketed mini coil springs of the center section 40*h* is illustrated being a tall mini coil spring 44, as described herein and shown in FIG. 5C. Each of the pocketed mini coil springs of each of the end sections 42*h* is illustrated being short mini coil springs 46, except for the tall pocketed mini coil springs 44 of the tall sections 108 within each end section 42*h*. In place of tall pocketed mini coil springs 44, tall pocketed mini coil springs 56 shown in FIG. 7C or tall pocketed mini coil springs 62 shown in FIG. 9C may be used in any of the tall sections 40*h*, 108 of posturized comfort layer 16*h*. Similarly, in place of short pocketed mini coil springs 46, short pocketed mini coil springs 58 shown in FIG. 8C or short pocketed mini coil springs 66 shown in FIG. 10C may be used in any of the short sections 106 of posturized comfort layer 16*h*. As best shown in FIG. 18D, each transversely extending row 48*h* of each end section 42*f* of pocketed mini coil springs is identical and comprises short and tall pocketed mini coil springs 44, 46. Each transversely extending row 48*h* of center section 40*h* of pocketed mini coil springs is identical and comprises solely tall pocketed mini coil springs 44.

Although FIG. 18D illustrates the pocketed mini coil springs having rectangular weld seams, circular weld seams may be incorporated into the pocketed mini coil springs in this or any embodiment shown or described herein. Although FIG. 18D illustrates only end sections 42*h* having spacer partial columns, it is within the scope of the invention that only center section 40*h* have spacer partial columns and end sections 42*f* lack spacer partial columns.

Figure 19:
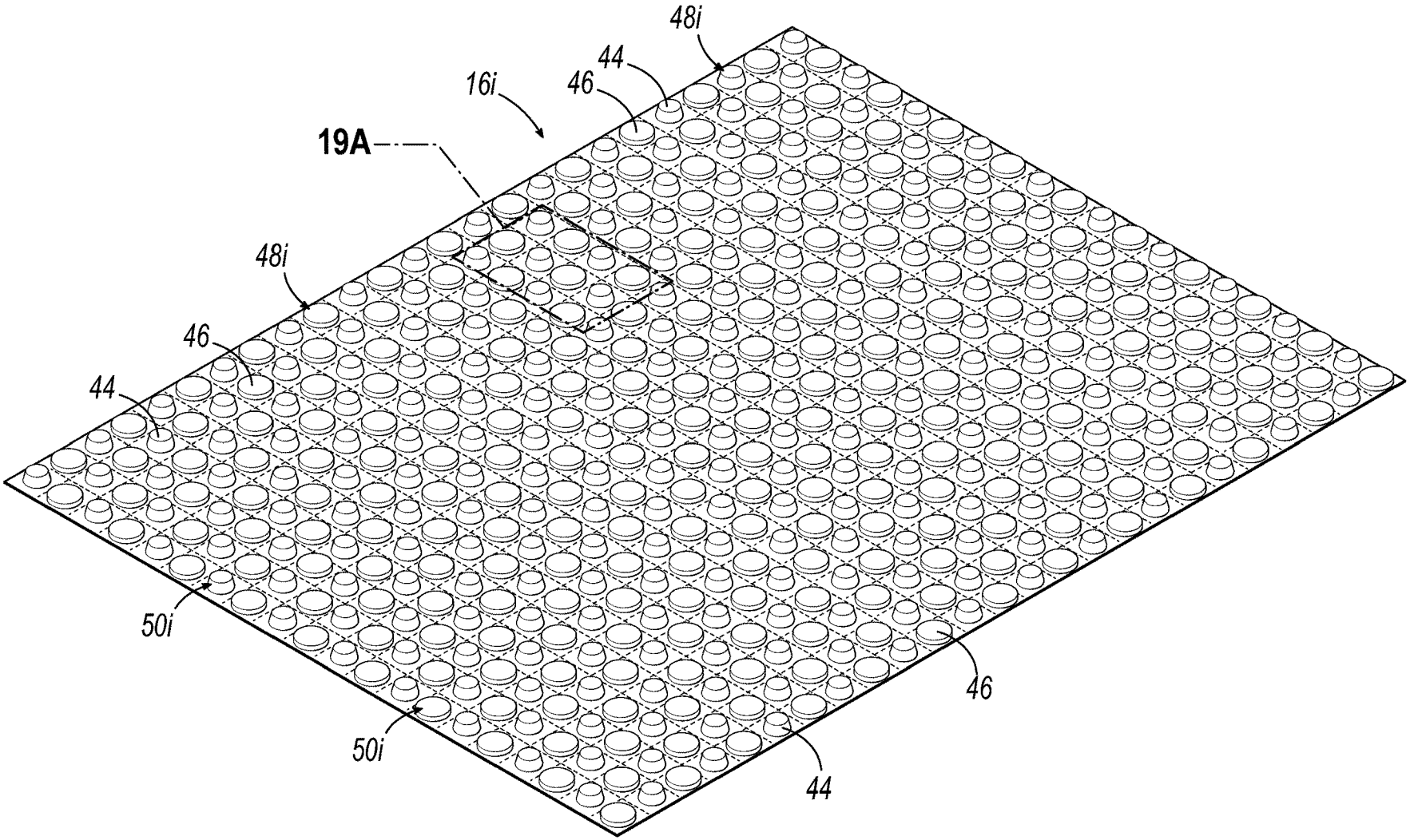
FIG. 19 is a perspective view of another comfort layer made in accordance with the invention which may be used in any bedding or seating product.
Figure 19A:
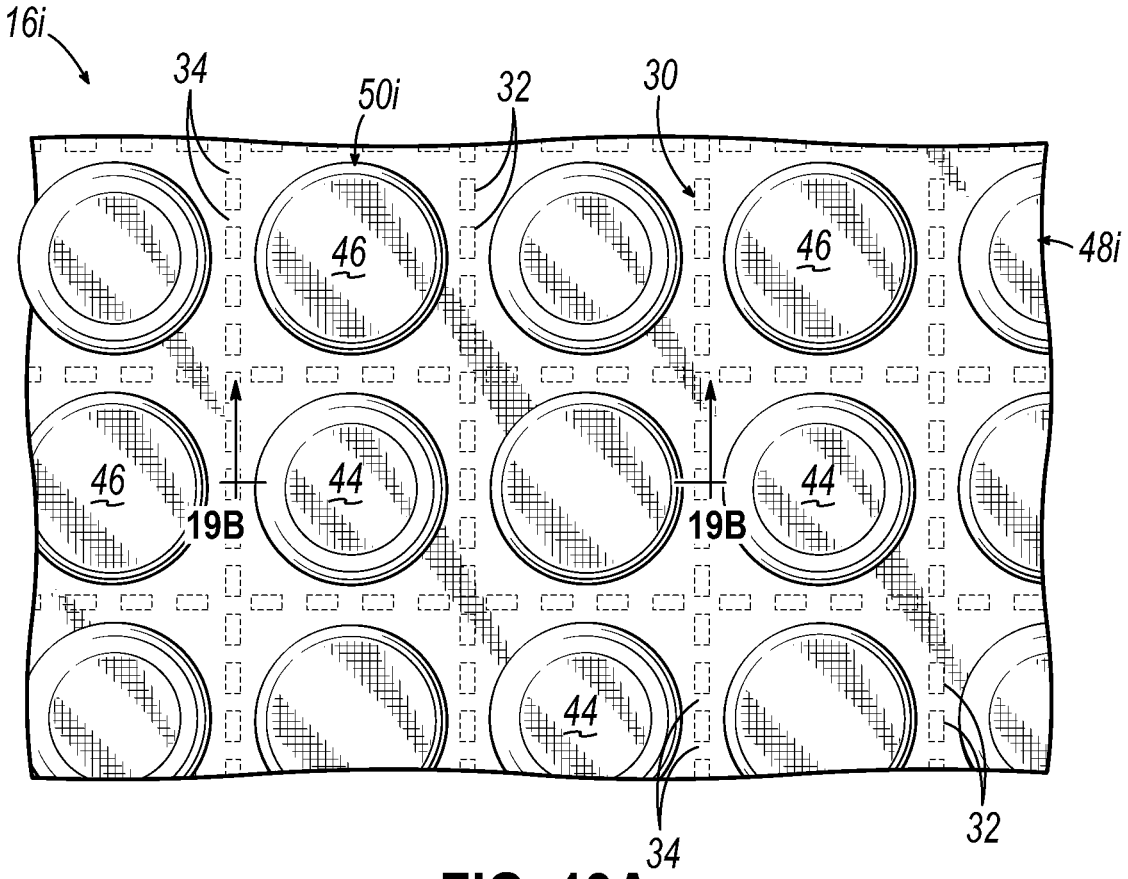
FIG. 19A is an enlarged top view of the area 19A of FIG. 19.
Figure 19B:
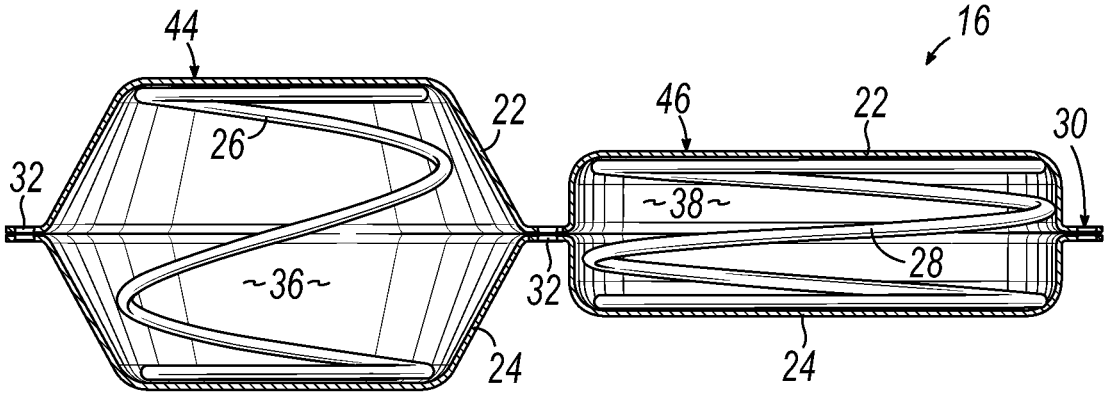
FIG. 19B is a cross-sectional view taken along the line 19B-19B of FIG. 19A.

FIGS. 19, 19A and 19B illustrate another comfort layer 16*i*. Comfort layer 16*i* comprises pocketed mini coil springs 44, 46 arranged in a matrix of aligned transversely extending rows 48*i* extending from side-to-side and longitudinally extending columns 50*i* extending from head-to-foot. Tall and short pocketed mini coil springs 44, 46, respectively, alternate along each row 48*i* and along each column 50*i*. In other words, every other pocketed mini coil spring is a tall pocketed mini coil spring 44 along each row 48*i* and along each column 50*i*. Similarly, every other pocketed mini coil spring is a short pocketed mini coil spring 46 along each row 48*i* and along each column 50*i*. One result of such an arrangement is a comfort layer having a uniform firmness or feel across the full width and full length of the comfort layer. In the industry, this configuration is known as a "checkerboard" pattern.

Each of the tall pocketed mini coil springs 44 is as described herein and shown in FIG. 5C. Each of the short pocketed mini coil springs 46 is as described herein and shown in FIG. 6C. In place of tall pocketed mini coil springs 44, tall pocketed mini coil springs 56 shown in FIG. 7C or tall pocketed mini coil springs 62 shown in FIG. 9C may be used in comfort layer 16*i*. Similarly, in place of short pocketed mini coil springs 46, short pocketed mini coil springs 58 shown in FIG. 8C or short pocketed mini coil springs 66 shown in FIG. 10C may be used in comfort layer 16*i*. Regardless of which tall and short pocketed mini coil springs are used, the diameter of the mini coil springs of the tall pocketed mini coil springs is less than the diameter of the mini coil springs of the short pocketed mini coil springs. Similarly, regardless of which tall and short pocketed mini coil springs are used, the pocketed height of the tall pocketed mini coil springs is greater than the pocketed height of the short pocketed mini coil springs.

FIG. 19B illustrates the components of comfort layer 16*i* shown in FIGS. 19 and 19A. The comfort layer 16*i* comprises a first or upper piece of fabric 22 and a second or lower piece of fabric 24 with a plurality of mini coil springs 26, 28 therebetween. The fabric pieces 22, 24 are joined together with rectangular weld seams 30, each rectangular weld seam 30 surrounding one of the mini coil springs 26 or 28. Each rectangular weld seam 30 comprises multiple straight or linear weld segments 32 with gaps 34 therebetween. The first and second pieces of fabric 22, 24 are joined together along each straight or linear weld segment 32 of each rectangular seam 30. The first and second pieces of fabric 22, 24 are not joined together along each gap 34 between adjacent weld segments 32 of each rectangular seam 30. The straight or linear weld segments 32 are strategically placed around a mini coil spring 26, 28 and create the rectangular seam 30. The two pieces of fabric 22, 24, in combination with one of the rectangular weld seams 30, define a pocket 36, 38 inside of which is at least one mini coil spring 26, 28, respectively. See FIGS. 19A and 19B.

Figure 20:
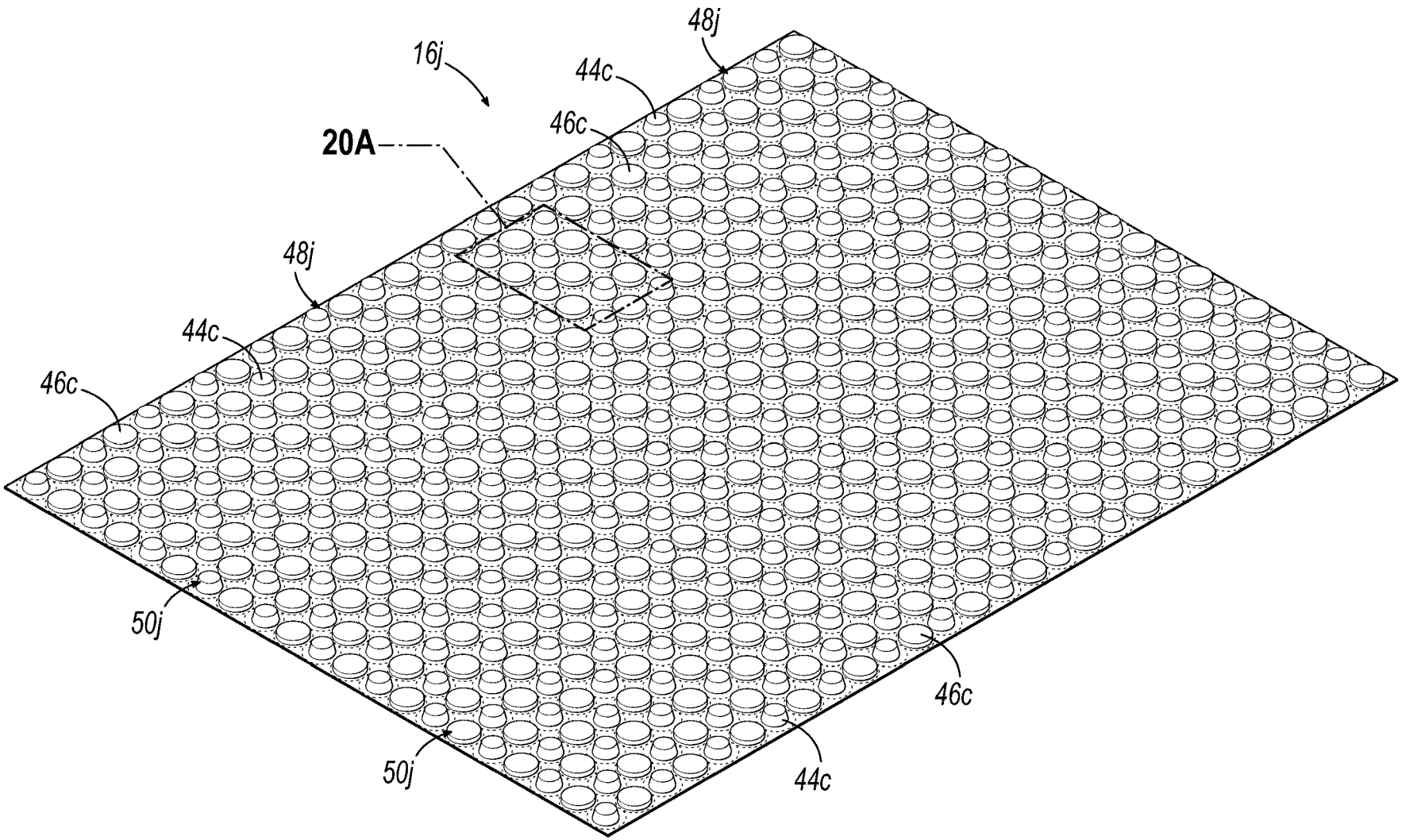
FIG. 20 is a perspective view of another comfort layer made in accordance with the invention which may be used in any bedding or seating product.
Figure 20A:
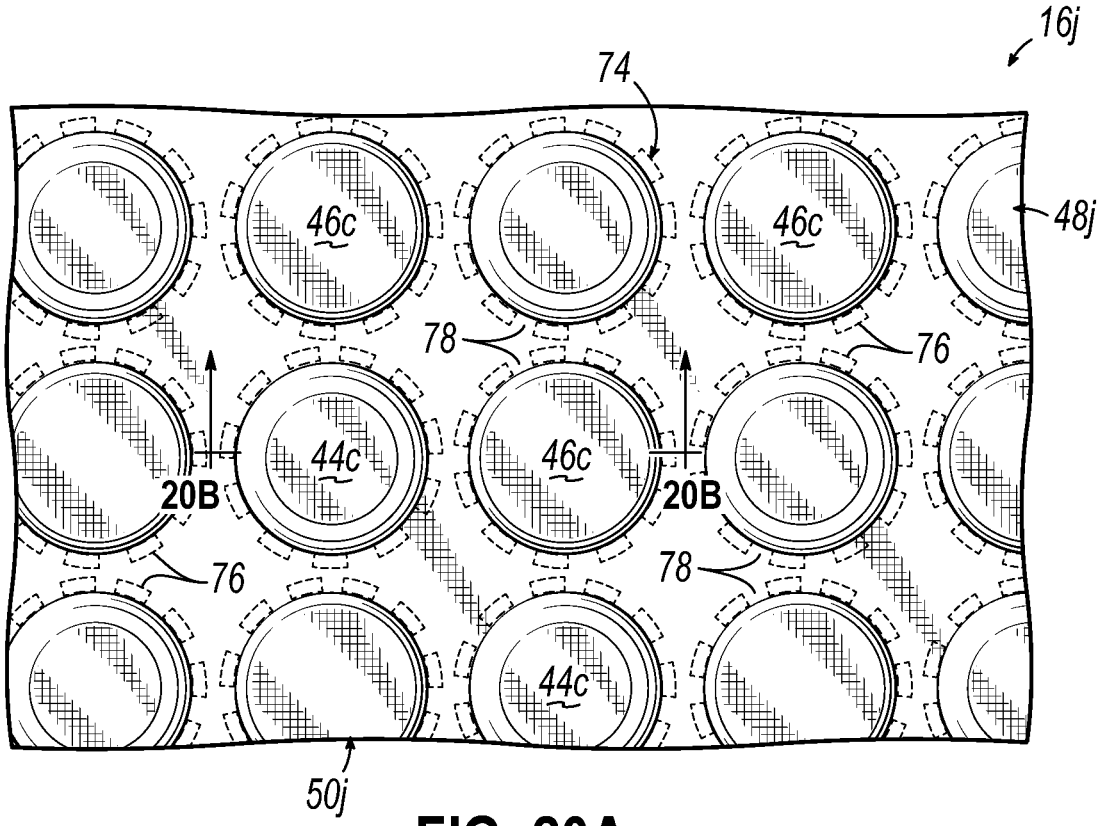
FIG. 20A is an enlarged top view of the area 20A of FIG. 20.
Figure 20B:
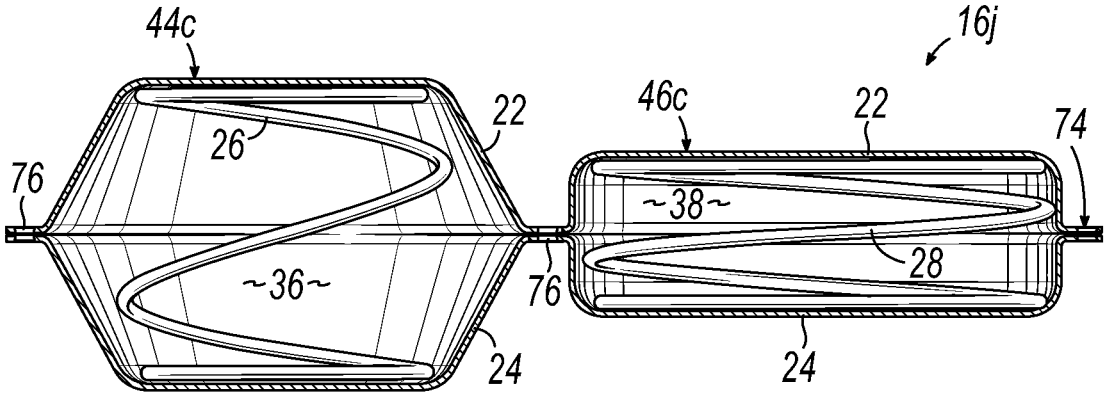
FIG. 20B is a cross-sectional view taken along the line 20B-20B of FIG. 20A.

FIGS. 20, 20A and 20B illustrate another comfort layer 16*j* having pocketed mini coil springs 44*c*, 46*c* with circular welds, rather than rectangular welds, joining the first and second pieces of fabric 22, 24. Comfort layer 16*j* comprises pocketed mini coil springs 44*c*, 46*c* arranged in a matrix of aligned transversely extending rows 48*j* extending from side-to-side and longitudinally extending columns 50*j* extending from head-to-foot. Tall and short pocketed mini coil springs 44*c*, 46*c*, respectively, alternate along each row 48*i* and along each column 50*i*. In other words, every other pocketed mini coil spring is a tall pocketed mini coil spring 44 along each row 48*j* and along each column 50*j*. Similarly, every other pocketed mini coil spring is a short pocketed mini coil spring 46 along each row 48*j* and along each column 50*j*. One result of such an arrangement is a comfort layer having a uniform firmness or feel across the full width and full length of the comfort layer. In the industry, this configuration is known as a "checkerboard" pattern.

Each of the tall pocketed mini coil springs 44*c* is as described herein and shown in FIG. 13A. Each of the short pocketed mini coil springs 46*c* is as described herein and shown in FIG. 13A. In place of tall pocketed mini coil springs 44*c*, tall pocketed mini coil springs 56 shown in FIG.

7C or tall pocketed mini coil springs 62 shown in FIG. 9C may be used in comfort layer 16*j*. Similarly, in place of short pocketed mini coil springs 46*c*, short pocketed mini coil springs, like short pocketed mini coil springs 58 shown in FIG. 8C or short pocketed mini coil springs 66 shown in FIG. 10C, may be used in comfort layer 16*i*. Regardless of which tall and short pocketed mini coil springs are used, the diameter of the mini coil springs of the tall pocketed mini coil springs is less than the diameter of the mini coil springs of the short pocketed mini coil springs. Similarly, regardless of which tall and short pocketed mini coil springs are used, the pocketed height of the tall pocketed mini coil springs is greater than the pocketed height of the short pocketed mini coil springs.

FIG. 20B illustrates the components of comfort layer 16*j* shown in FIGS. 20, 20A and 20B. The comfort layer 16*j* comprises a first or upper piece of fabric 22 and a second or lower piece of fabric 24 with a plurality of mini coil springs 26, 28 therebetween. The fabric pieces 22, 24 are joined together with large circular weld seams 74, each circular weld seam 74 surrounding a mini coil spring 26, 28. Each circular weld seam 74 comprises multiple arced or curved weld segments 76 with gaps 78 therebetween. The first and second pieces of fabric 22, 24 are joined together along each arced or curved weld segment 76 of each circular weld seam 74. The first and second pieces of fabric 22, 24 are not joined together along each gap 78 between adjacent weld segments 76 of each circular seam 74. The curved weld segments 76 are strategically placed around a mini coil spring 26, 28 and create the circular seam 74. The two pieces of fabric 22, 24, in combination with one of the circular weld seams 74, define a cylindrical-shaped pocket 36, 38 inside of which is at least one mini coil spring 26, 28, respectively. See FIGS. 20A and 20B.

The embodiment of comfort layer 16*j* shown in FIGS. 20, 20A and 20B illustrates all the circular weld seams 74 being the same diameter. The difference in the height of the pocketed mini coil springs 44, 46 is due to the different mini coil springs 26, 28 being inside the pockets 36, 38, respectively. As stated herein, within the scope of the invention, the mini coil springs within a comfort layer having a checkerboard arrangement may be identical, but the diameter of the circular weld seams different to create pockets of different heights.

Although the drawings show a certain size of the curved weld segments 76 of circular weld seams 74, the size of the curved weld segments 76 of circular weld seams 74 are not intended to be limited by the illustrations; they may be any desired size. Similarly, although the drawings show the circular weld seams 74 having a certain diameter, the diameter of the illustrated circular weld seams 74 is not intended to be limiting.

Figure 21:
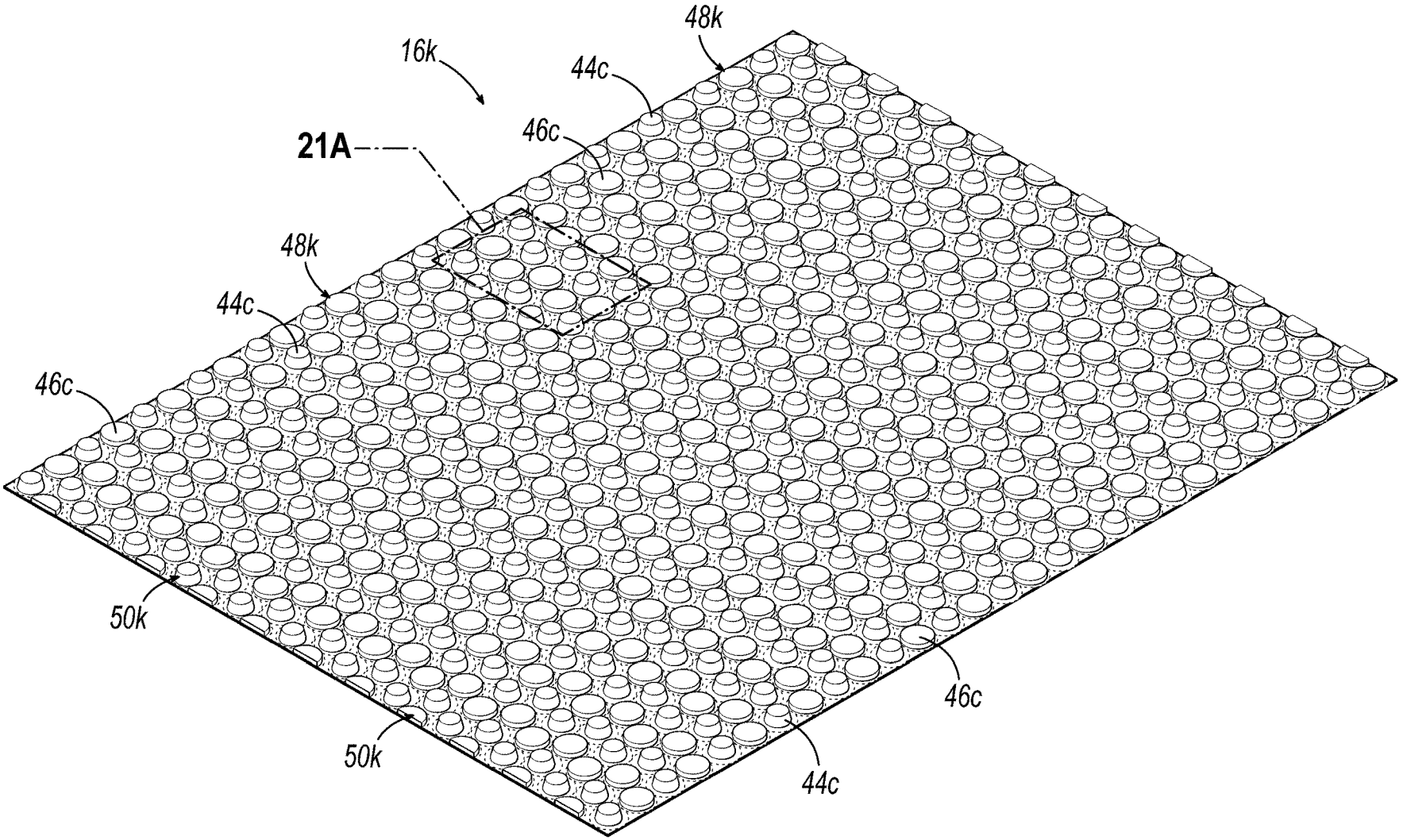
FIG. 21 is a perspective view of another comfort layer made in accordance with the invention which may be used in any bedding or seating product.
Figure 21A:
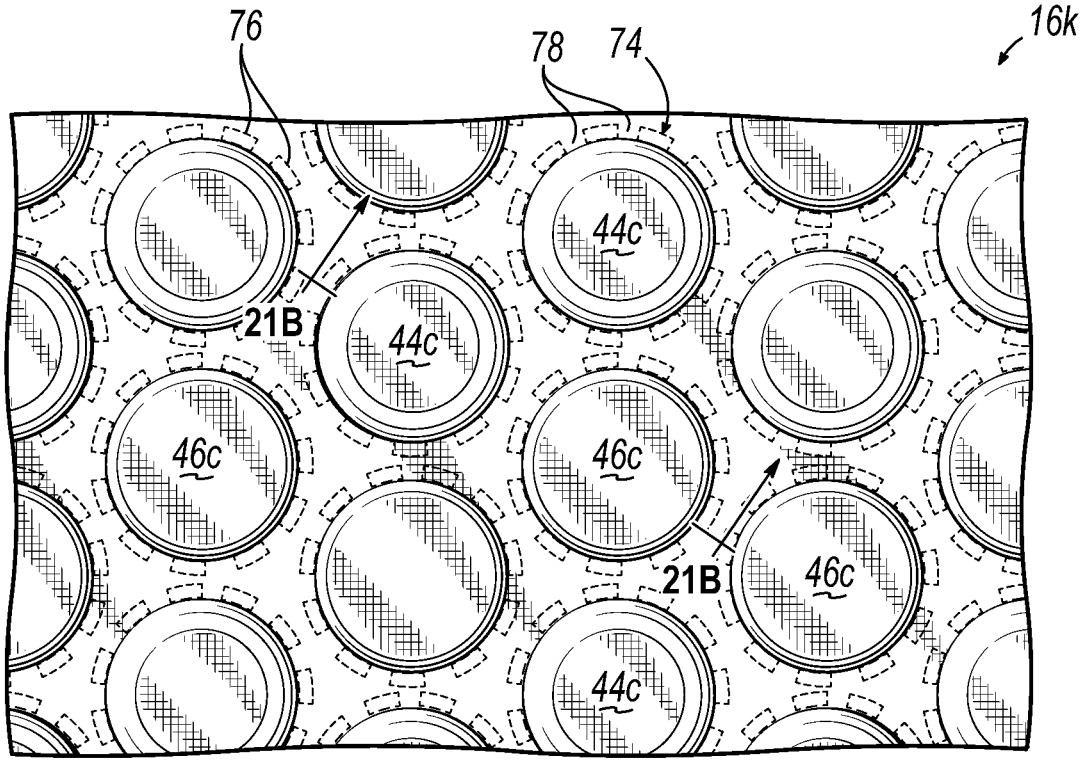
FIG. 21A is an enlarged top view of the area 21A of FIG. 21.
Figure 21B:
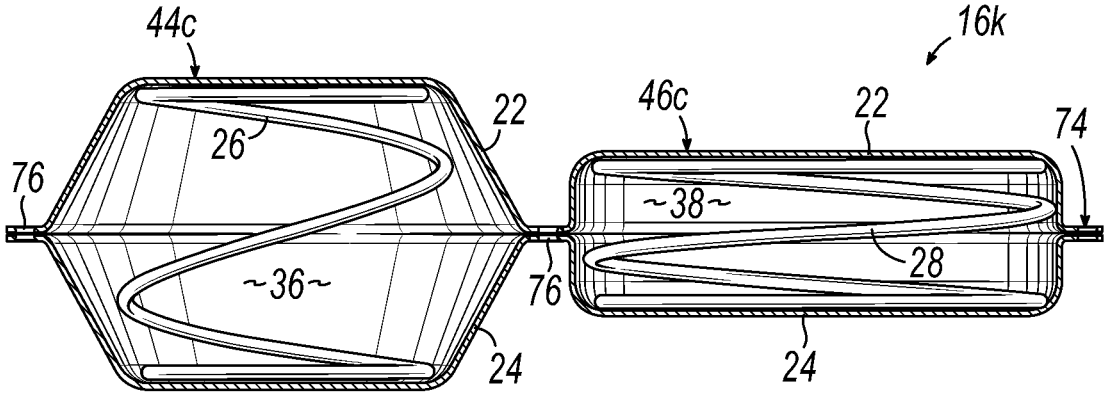
FIG. 21B is a cross-sectional view taken along the line 21B-21B of FIG. 21A.

FIGS. 21, 21A and 21B illustrate another comfort layer 16*k* having the same pocketed mini coil springs 44*c*, 46*c* as the comfort layer 16*j* shown in FIGS. 20, 20A and 20B with circular welds joining the first and second pieces of fabric 22, 24. The components of comfort layer 16*k* are the same as the components of comfort layer 16*j*. However, the orientation of the pocketed mini coil springs 44*c*, 46*c* in comfort layer 16*k* is different than the orientation of the pocketed mini coil springs 44*c*, 46*c* in comfort layer 16*j*.

Comfort layer 16*k* comprises pocketed mini coil springs 44*c*, 46*c* arranged in a matrix of aligned transversely extending rows 48*k* extending from side-to-side and longitudinally extending columns 50*k* extending from head-to-foot. Tall and short pocketed mini coil springs 44*c*, 46*c*, respectively, alternate along each row 48*k* and along each column 50*k*. In other words, every other pocketed mini coil spring is a tall pocketed mini coil spring 44 along each row 48*k* and along each column 50*k*. Similarly, every other pocketed mini coil spring is a short pocketed mini coil spring 46*c* along each row 48*k* and along each column 50*k*. The result of such an arrangement is a comfort layer having a uniform firmness or feel across the full width and full length of the comfort layer. As best illustrated in FIG. 21A, the pocketed mini coil springs of one column are offset from, rather than aligned with, the pocketed mini coil springs of the adjacent columns, which is a different configuration than the checkerboard configuration shown in comfort layer 16*j* illustrated in FIGS. 20, 20A and 20B. This configuration of pocketed mini coil springs in known in the industry as a nested configuration.

Each of the tall pocketed mini coil springs 44*c* is as described herein and shown in FIG. 13A. Each of the short pocketed mini coil springs 46*c* is as described herein and shown in FIG. 13A. In place of tall pocketed mini coil springs 44*c*, tall pocketed mini coil springs, like tall pocketed mini coil springs 56 shown in FIG. 7C or tall pocketed mini coil springs 62 shown in FIG. 9C, may be used in comfort layer 16*k*. Similarly, in place of short pocketed mini coil springs 46*c*, short pocketed mini coil springs like short pocketed mini coil springs 58 shown in FIG. 8C or short pocketed mini coil springs 66 shown in FIG. 10C may be used in comfort layer 16*k*. Regardless of which tall and short pocketed mini coil springs are used, the diameter of the mini coil springs of the tall pocketed mini coil springs is less than the diameter of the mini coil springs of the short pocketed mini coil springs. Similarly, regardless of which tall and short pocketed mini coil springs are used, the pocketed height of the tall pocketed mini coil springs is greater than the pocketed height of the short pocketed mini coil springs.

The embodiment of comfort layer 16*j* shown in FIGS. 20, 20A and 20B illustrates all the circular weld seams 74 being the same diameter. The difference in the height of the pocketed mini coil springs 44, 46 is due to the different mini coil springs 26, 28 being inside the pockets 36, 38, respectively. It is within the scope of the invention that the mini coil springs within comfort layer 16*j* shown in FIGS. 21, 21A and 21B be identical, but the diameter of the circular weld seams of pocketed mini coil springs 44*c*, 46*c* within comfort layer 16*j* be different to create pocketed mini coil springs of different heights.

Figure 22:
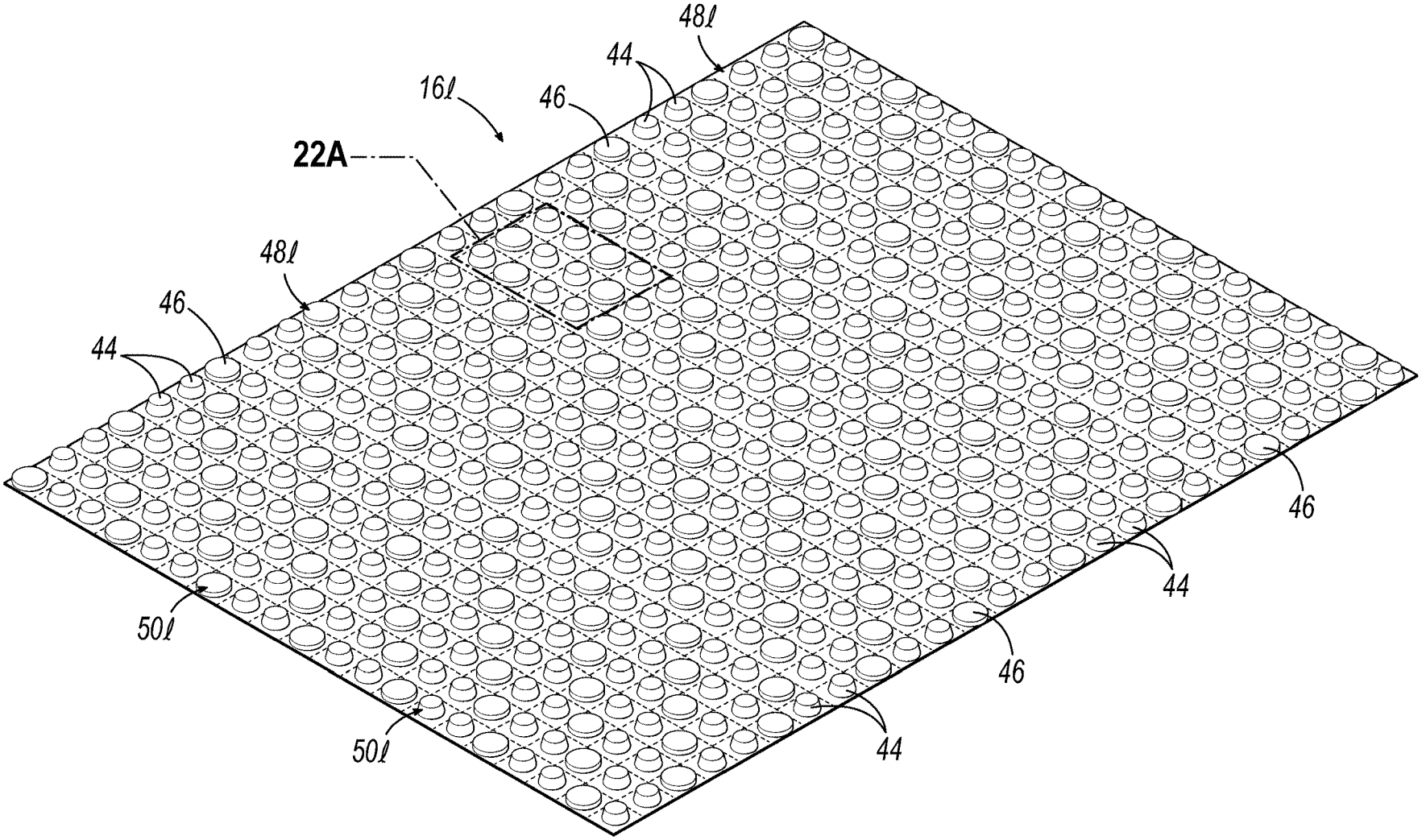
FIG. 22 is a perspective view of another comfort layer made in accordance with the invention which may be used in any bedding or seating product.
Figure 22A:
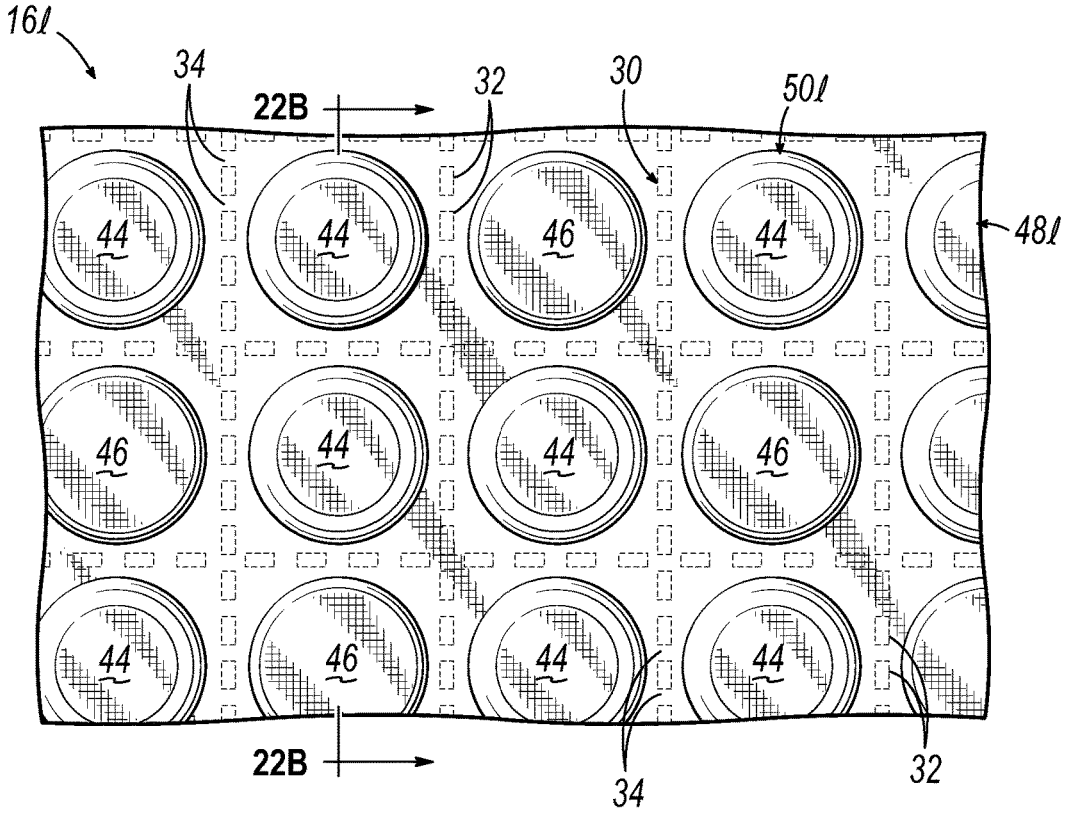
FIG. 22A is an enlarged top view of the area 22A of FIG. 22.
Figure 22B:
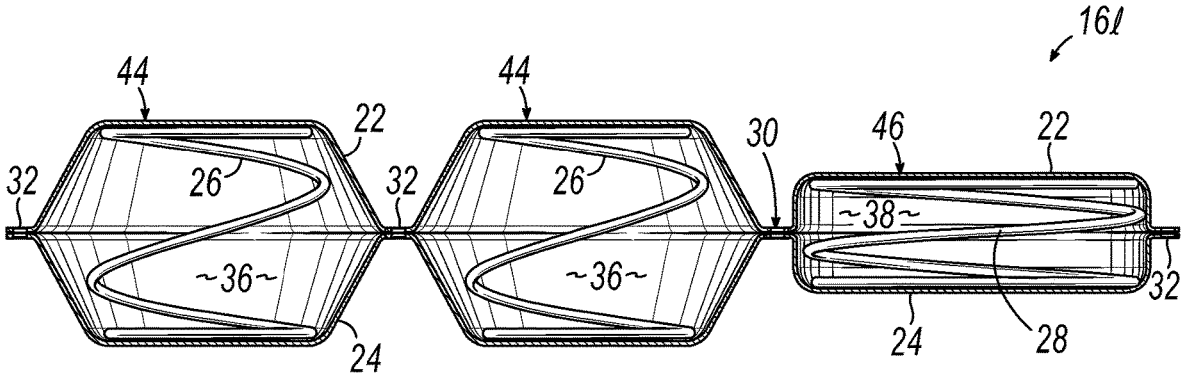
FIG. 22B is a cross-sectional view taken along the line 22B-22B of FIG. 22A.

FIGS. 22, 22A and 22B illustrate another comfort layer 16*l*. Comfort layer 16*l* comprises pocketed mini coil springs 44, 46 arranged in a matrix of aligned transversely extending rows 48*l* extending from side-to-side and longitudinally extending columns 50*l* extending from head-to-foot. Tall and short pocketed mini coil springs 44, 46, respectively, extend in a repeating pattern along each row 48*l* and along each column 50*l*. In the illustrated embodiment, every third pocketed mini coil spring is a short pocketed mini coil spring 46 along each row 48*l* and along each column 50*l*. Similarly, between a pair of adjacent short pocketed mini coil springs 46 are two tall pocketed mini coil springs 46 along each row 48*l* and along each column 50*l*. One result of such an arrangement is a comfort layer having a uniform firmness or feel across the full width and full length of the comfort layer. Although one repeating pattern is illustrated, other repeating patterns are within the scope of the invention regardless of whether along one or more columns or one or more rows. For example, a repeating pattern of tall, tall, short, short may extend along each column or row. This example is merely one of many examples.

Each of the tall pocketed mini coil springs 44 is as described herein and shown in FIG. 5C. Each of the short pocketed mini coil springs 46 is as described herein and shown in FIG. 6C. In place of tall pocketed mini coil springs 44, tall pocketed mini coil springs 56 shown in FIG. 7C or tall pocketed mini coil springs 62 shown in FIG. 9C may be used in comfort layer 16*l*. Similarly, in place of short pocketed mini coil springs 46, short pocketed mini coil springs 58 shown in FIG. 8C or short pocketed mini coil springs 66 shown in FIG. 10C may be used in comfort layer 16*l*. Regardless of which tall and short pocketed mini coil springs are used, the diameter of the mini coil springs of the tall pocketed mini coil springs is less than the diameter of the mini coil springs of the short pocketed mini coil springs. Similarly, regardless of which tall and short pocketed mini coil springs are used, the pocketed height of the tall pocketed mini coil springs is greater than the pocketed height of the short pocketed mini coil springs.

FIG. 22B illustrates the components of comfort layer 16*l* shown in FIGS. 22 and 22A. The comfort layer 16*l* comprises a first or upper piece of fabric 22 and a second or lower piece of fabric 24 with a plurality of mini coil springs 26, 28 therebetween. The fabric pieces 22, 24 are joined together with rectangular weld seams 30, each rectangular weld seam 30 surrounding one of the mini coil springs 26 or 28. Each rectangular weld seam 30 comprises multiple straight or linear weld segments 32 with gaps 34 therebetween. The first and second pieces of fabric 22, 24 are joined together along each straight or linear weld segment 32 of each rectangular seam 30. The first and second pieces of fabric 22, 24 are not joined together along each gap 34 between adjacent weld segments 32 of each rectangular seam 30. The straight or linear weld segments 32 are strategically placed around a mini coil spring 26, 28 and create the rectangular seam 30. The two pieces of fabric 22, 24, in combination with one of the rectangular weld seams 30, define a pocket 36, 38 inside of which is at least one mini coil spring 26, 28, respectively. See FIGS. 22A and 22B. Although not shown, comfort layer 16*l* may be made with circular welds, either continuous or segmented or any combination thereof. This is true for any of the comfort layers shown or described herein.

Figure 23:
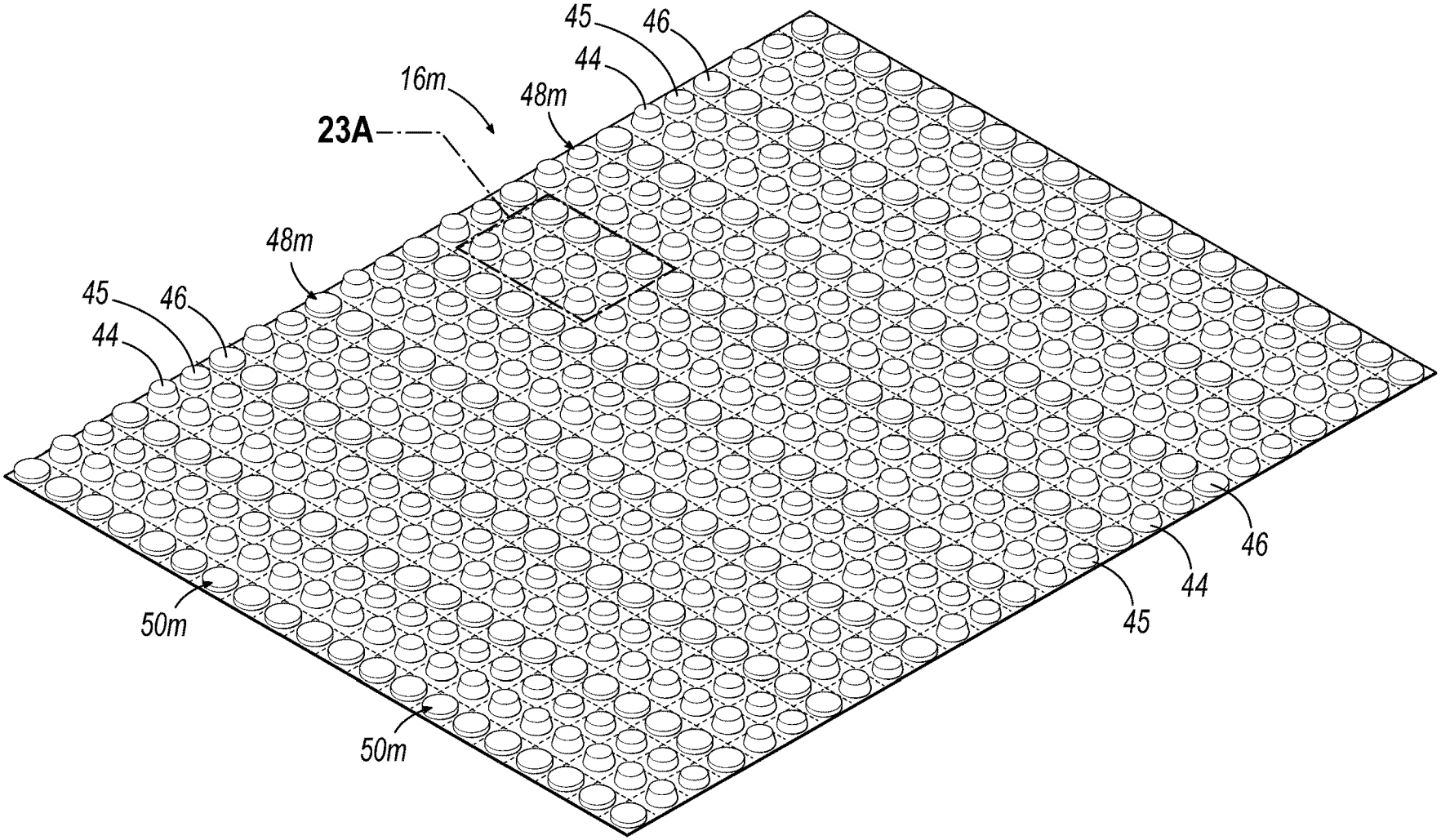
FIG. 23 is a perspective view of another comfort layer made in accordance with the invention which may be used in any bedding or seating product.
Figure 23A:
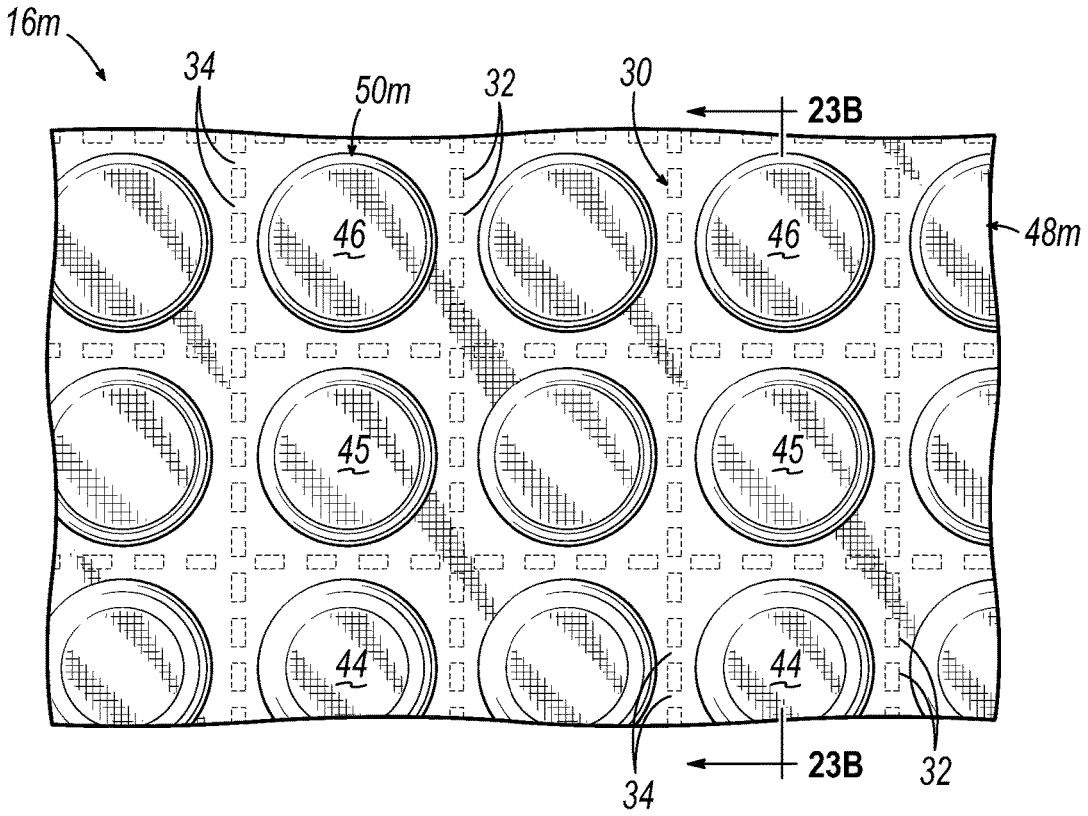
FIG. 23A is an enlarged top view of the area 23A of FIG. 23.
Figure 23B:
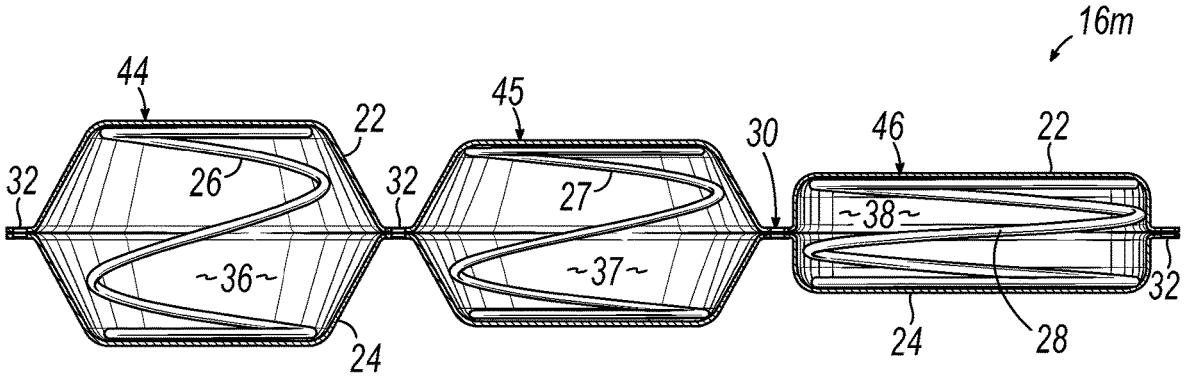
FIG. 23B is a cross-sectional view taken along the line 23B-23B of FIG. 23A.

FIGS. 23, 23A and 23B illustrate another comfort layer 16*m*. Comfort layer 16*m* comprises pocketed mini coil springs 44, 46 arranged in a matrix of aligned transversely extending rows 48*m* extending from side-to-side and longitudinally extending columns 50*m* extending from head-to-foot. Each of the transversely extending rows 48*m* extending from side-to-side has pocketed mini coil springs of the same height along the row 48*m*. In the illustrated embodiment, each third row 48*m* of pocketed mini coil springs comprises short pocketed mini coil springs 46.

As shown in FIG. 23, along each column 50*m*, tall, medium and short pocketed mini coil springs 44, 45, 46, respectively, extend in a repeating pattern. In the illustrated embodiment, every third pocketed mini coil spring is a short pocketed mini coil spring 46, every third pocketed mini coil spring is a medium pocketed mini coil spring 45 and every third pocketed mini coil spring is a tall pocketed mini coil spring 44 along each column 50*l*. The medium pocketed mini coil spring 45 has a pocketed height greater than the pocketed height of the short pocketed mini coil spring 46 and less than the pocketed height of the tall pocketed mini coil spring 44. One result of such an arrangement is a comfort layer having a uniform firmness or feel across the full width and full length of the comfort layer. Although one repeating pattern is illustrated, other repeating patterns are within the scope of the invention regardless of whether along one or more columns or one or more rows. For example, a repeating pattern of tall, tall, medium, medium, short, short may extend along each column or row. This example is merely one of many examples.

Each of the tall pocketed mini coil springs 44 is as described herein and shown in FIG. 5C. Each of the short pocketed mini coil springs 46 is as described herein and shown in FIG. 6C. In place of tall pocketed mini coil springs 44, tall pocketed mini coil springs 56 shown in FIG. 7C or tall pocketed mini coil springs 62 shown in FIG. 9C may be used in comfort layer 16*m*. Similarly, in place of short pocketed mini coil springs 46, short pocketed mini coil springs 58 shown in FIG. 8C or short pocketed mini coil springs 66 shown in FIG. 10C may be used in comfort layer 16*m*. Regardless of which tall and short pocketed mini coil springs are used, the diameter of the mini coil springs of the tall pocketed mini coil springs is less than the diameter of the mini coil springs of the short pocketed mini coil springs. Similarly, regardless of which tall and short pocketed mini coil springs are used, the pocketed height of the tall pocketed mini coil springs is greater than the pocketed height of the short pocketed mini coil springs.

FIG. 23B illustrates the components of comfort layer 16*m* shown in FIGS. 23 and 23A. The comfort layer 16*m* comprises a first or upper piece of fabric 22 and a second or lower piece of fabric 24 with a plurality of mini coil springs 26, 28 therebetween. The fabric pieces 22, 24 are joined together with rectangular weld seams 30, each rectangular weld seam 30 surrounding one of the mini coil springs 26 or 28. Each rectangular weld seam 30 comprises multiple straight or linear weld segments 32 with gaps 34 therebetween. The first and second pieces of fabric 22, 24 are joined together along each straight or linear weld segment 32 of each rectangular seam 30. The first and second pieces of fabric 22, 24 are not joined together along each gap 34 between adjacent weld segments 32 of each rectangular seam 30. The straight or linear weld segments 32 are strategically placed around a mini coil spring 26, 28 and create the rectangular seam 30. The two pieces of fabric 22, 24, in combination with one of the rectangular weld seams 30, define a pocket 36, 38 inside of which is at least one mini coil spring 26, 28, respectively. See FIGS. 23A and 23B. Although not shown, comfort layer 16*m* may be made with circular welds, either continuous or segmented or any combination thereof. This is true for any of the comfort layers shown or described herein.

While we have described several preferred embodiments of this invention, persons skilled in this art will appreciate that other configurations of comfort layers may be utilized in the practice of this invention. Similarly, such persons will appreciate that each pocket may contain any number of coil springs or other type of spring, made of any desired material. Persons skilled in the art may further appreciate that the segments of the weld seams may be stitched, glued or otherwise adhered or bonded. Therefore, we do not intend to be limited except by the scope of the following appended claims.

We claim:

1. In combination, a core of a bedding or seating product and a comfort layer, said combination comprising:

a core; and a comfort layer overlaying the core, said comfort layer comprising first and second pieces of fabric and a matrix of pocketed mini coil springs between the first and second pieces of fabric, each mini coil spring being contained within a pocket, said pocket having a weld seam at least partially around the pocket joining the first and second pieces of fabric of the pocket;

said comfort layer having aligned rows and columns of pocketed mini coil springs within pockets, wherein the pocketed mini coil springs within at least one of the rows and columns have a repeating pattern of at least two different heights, the pockets being constructed using only the first and second pieces of fabric.

2. The combination of claim 1 wherein the pocketed mini coil springs within each of the rows and columns have a repeating pattern of at least two different heights.

3. The combination of claim 2 wherein at least one weld seam has multiple weld segments.

4. The combination of claim 1 wherein the pocketed mini coil springs within the at least one of the rows and columns have different heights due, at least in part, to different mini coil springs being inside the pockets of the pocketed mini coil springs.

5. The combination of claim 1 wherein along at least one of the rows and columns every other pocketed mini coil spring has a first height and every other pocketed mini coil spring has a second height, the second height being different than the first height.

6. The combination of claim 1 wherein the pocketed mini coil springs within at least one of the rows and columns have a repeating pattern of at least three different heights.

7. The combination of claim 5 wherein the mini coil springs of the pocketed mini coil springs having the first height have a different diameter than the mini coil springs of the pocketed mini coil springs having the second height.

8. In combination, a core of a bedding or seating product and a comfort layer, said combination comprising:

a core;

a comfort layer overlaying the core, said comfort layer comprising a matrix of mini coil springs;

a first piece of fabric on one side of the matrix of mini coil springs;

a second piece of fabric on another side of the matrix of mini coil springs, the first and second pieces of fabric being joined with weld seams at least partially around each of the mini coil springs joining the first and second pieces of fabric and creating individual pockets which contain the mini coil springs;

said comfort layer having rows and columns of pocketed mini coil springs within pockets wherein said pocketed mini coil springs are arranged in a checkerboard pattern, every other pocketed mini coil spring having a first height and every other pocketed mini coil spring having a second height, the second height being different than the first height, the pockets being constructed using only the first and second pieces of fabric.

9. The combination of claim 8 wherein the mini coil springs of the pocketed mini coil springs having the first height have a different diameter than the mini coil springs of the pocketed mini coil springs having the second height.

10. The combination of claim 8 wherein the mini coil springs of the pocketed mini coil springs having the first height have a different out-of-pocket height than the mini coil springs of the pocketed mini coil springs having the second height.

11. The combination of claim 8 wherein the weld seams comprise weld segments with gaps between the weld segments.

12. The combination of claim 11 wherein said weld seams are circular and the weld segments are curved.

13. The combination of claim 11 wherein the weld seams are rectangular and the weld segments of the pocket are straight.

14. The combination of claim 8 wherein the weld seams are the same size.

15. In combination, a core of a bedding or seating product and a comfort layer, said combination comprising:

a core;

a comfort layer overlaying the core, the comfort layer comprising mini coil springs;

a first piece of fabric on one side of the mini coil springs;

a second piece of fabric on another side of the mini coil springs, the first and second pieces of fabric being joined with weld seams at least partially around each of the mini coil springs to create individual pockets which contain the mini coil springs;

said comfort layer having rows and columns of pocketed mini coil springs arranged in a nested configuration, wherein within at least one of the rows and columns every other pocketed mini coil spring has a first height and every other pocketed mini coil spring has a second height, the second height being different than the first height, the individual pockets being constructed using only the first and second pieces of fabric.

16. The combination of claim 15 wherein the weld seams comprise spaced weld segments.

17. The combination of claim 15 wherein the weld seams are circular.

18. The combination of claim 15 wherein the weld seams are rectangular.

19. The combination of claim 15 wherein within multiple rows and columns every other pocketed mini coil spring has a first height and every other pocketed mini coil spring has a second height, the second height being different than the first height.

* * * * *